US010774401B2

(12) United States Patent
Takeda et al.

(10) Patent No.: US 10,774,401 B2
(45) Date of Patent: Sep. 15, 2020

(54) COPPER ALLOY AND METHOD FOR PRODUCING SAME

(71) Applicants: NGK INSULATORS, LTD., Nagoya (JP); National University Corporation YOKOHAMA National University, Yokohama (JP)

(72) Inventors: Mahoto Takeda, Yokohama (JP); Koudai Sasaki, Yokohama (JP); Daisuke Kaneko, Yokohama (JP); Naokuni Muramatsu, Nagoya (JP); Takanari Nakajima, Nagoya (JP)

(73) Assignees: NGK Insulators, Ltd., Nagoya (JP); National University Corporation Yokohama Natinal University, Yokohama-Shi (JP)

( * ) Notice: Subject to any disclaimer, the term of this patent is extended or adjusted under 35 U.S.C. 154(b) by 0 days.

(21) Appl. No.: 16/136,684

(22) Filed: Sep. 20, 2018

(65) Prior Publication Data

US 2019/0017148 A1 Jan. 17, 2019

Related U.S. Application Data

(63) Continuation of application No. PCT/JP2017/012128, filed on Mar. 24, 2017.

(60) Provisional application No. 62/313,228, filed on Mar. 25, 2016.

(51) Int. Cl.

| | |
|---|---|
| ***C22C 9/02*** | (2006.01) |
| ***C22F 1/08*** | (2006.01) |
| ***C22C 9/05*** | (2006.01) |
| ***C22F 1/00*** | (2006.01) |

(52) U.S. Cl.

CPC ..... *C22C 9/02* (2013.01); *C22C 9/05* (2013.01); *C22F 1/00* (2013.01); *C22F 1/006* (2013.01); *C22F 1/08* (2013.01)

(58) Field of Classification Search

CPC .. C22C 1/045; C22C 9/00; C22C 9/02; C22C 9/05; C22F 1/006; C22F 1/08

See application file for complete search history.

(56) References Cited

U.S. PATENT DOCUMENTS

| | | | |
|---|---|---|---|
| 2004/0241038 | A1 | 12/2004 | Hofmann et al. |
| 2015/0200392 | A1 | 7/2015 | Yamamoto et al. |

FOREIGN PATENT DOCUMENTS

| | | | |
|---|---|---|---|
| CN | 105369043 | | 8/2017 |
| JP | 2004-263298 | A1 | 9/2004 |
| WO | 2014/034104 | A1 | 3/2014 |

OTHER PUBLICATIONS

"Glossary of Metallurgical and Metalworking Terms," Metals Handbook, ASM Handbooks Online, ASM International, 2002, pp. 1, 123, 124, 257. (Year: 2002).*

(Continued)

*Primary Examiner* — Vanessa T. Luk

(74) *Attorney, Agent, or Firm* — Burr & Brown, PLLC

(57) ABSTRACT

A copper alloy disclosed in the present description has a basic alloy composition represented by $Cu_{100-(x+y)}Sn_xMn_y$ (where 8≤x≤16 and 2≤y≤10 are satisfied), in which a main phase is a βCuSn phase with Mn dissolved therein, and the βCuSn phase undergoes martensitic transformation when heat-treated or worked.

16 Claims, 28 Drawing Sheets

(56) References Cited

OTHER PUBLICATIONS

*Journal of Textile Engineering* , 1989, vol. 2, No. 11, pp. 587-592 (with partial translation).
C.M. Wayman, "Some Applications of Shape Memory Alloys," *Journal of the Japan Institute of Metals and Materials*, 19 (1980), pp. 323-332 (with partial translation).
S. Prashantha et al., "Shape Memory Effect Cu—Sn—Mn Ternary Shape Memory Alloy Processed by Ingot Metallurgy," *International Journal of Metallurgical & Materials Science and Engineering*(*IJMMSE*), Mar. 2012, vol. 2, Issue 1, pp. 12-20.
X.J. Liu et al., "Experimental Investigation and Thermodynamic Calculation of the Phase Equilibria in the Cu—Sn and Cu—Sn—Mn Systems," *Metallurgical and Materials Transactions A*, Jun. 2004, vol. 35A, Issue 6, pp. 1641-1654.
Rupa Dasgupta et al., "A look into Cu-Based Shape Memory Alloys: Present Scenario and Future Prospects," *Journal of Materials Research*, Aug. 28, 2014, vol. 29, No. 16, pp. 1681-1698.
International Search Report and Written Opinion (Application No. PCT/JP2017/012128) dated Jun. 6, 2017.
English translation of International Preliminary Report on Patentability (Application No. PCT/JP2017/012128) dated Oct. 4, 2018.
J. Van Humbeeck et al. "*Shape Memory Alloys, Types and Functionalities*," https://onlinelibrary.wiley.com/full/10.1002/0471216275.esm073, Encyclopedia of Smart Materials, Jul. 15, 2002.
European Search Report (Application No. 17770435.0) dated Sep. 20, 2019.

* cited by examiner

EXPERIMENTAL EXAMPLE 7-2

EXPERIMENTAL EXAMPLE 7-3

EXPERIMENTAL EXAMPLE 7-4

EXPERIMENTAL EXAMPLE 7-5

Fig. 30A EXPERIMENTAL EXAMPLE 7-2
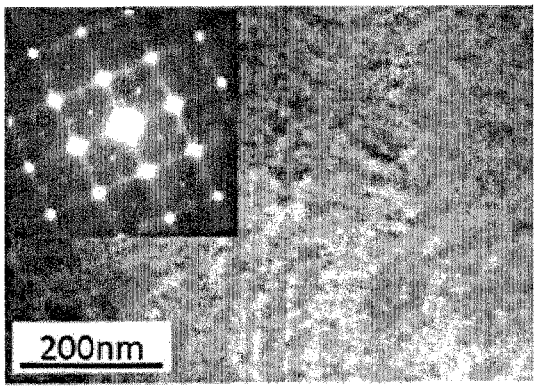
Fig. 30B EXPERIMENTAL EXAMPLE 7-3
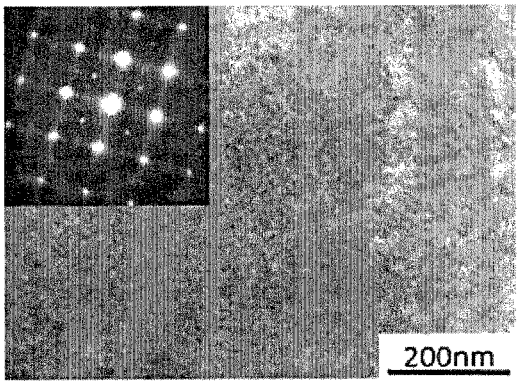
Fig. 30C EXPERIMENTAL EXAMPLE 7-4
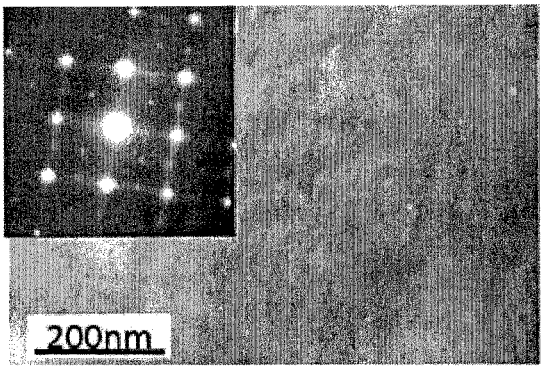
Fig. 30D EXPERIMENTAL EXAMPLE 7-5
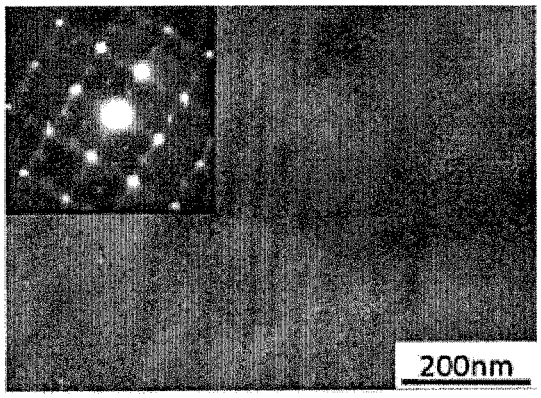
Fig. 30E EXPERIMENTAL EXAMPLE 7-6
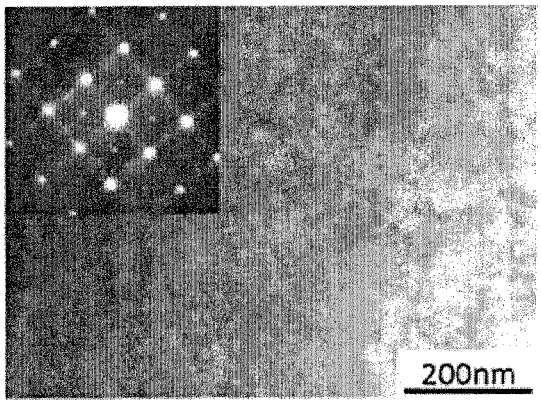

COPPER ALLOY AND METHOD FOR PRODUCING SAME

BACKGROUND OF THE INVENTION

1. Field of the Invention

The disclosure in the present description relates to a copper alloy and a method for producing same.

2. Description of the Related Art

Proposals of copper alloys having shape memory properties (for example, see NPL 1 and NPL 2, etc.) have been made heretofore. Examples of such copper alloys include Cu—Zn alloys, Cu—Al alloys, and Cu—Sn alloys. These copper shape memory alloys all have a parent phase called a β phase (phase having a crystal structure related to bcc) that is stable at high temperature, and this parent phase contains regularly ordered alloy elements. When the β phase is quenched to about room temperature to enter a metastable state, and is then further cooled, the β phase undergoes martensitic transformation and its crystal structure changes instantaneously.

CITATION LIST

Non Patent Literature

NPL 1: Journal of Textile Engineering, 42 (1989), 587

NPL 2: Journal of the Japan Institute of Metals and Materials, 19 (1980), 323

SUMMARY OF THE INVENTION

Among these copper alloys, Cu—Zn—Al, Cu—Zn—Sn, and Cu—Al—Mn copper alloys are advantageous in terms of cost due to their low raw material cost; however, they do not have as high a recovery rate as Ni—Ti alloys, which are common shape memory alloys. Ni—Ti alloys have excellent SME properties, in other words, a high recovery rate, but are expensive due to high Ti contents. Moreover, Ni—Ti alloys have low thermal and electrical conductivity and can only be used at a low temperature, 100° C. or lower. For Cu—Sn alloys, the problem has been that the internal structure changes with time due to room-temperature aging, and the shape memory properties change as a result. Since room-temperature aging causes diffusion of Sn and induces precipitation of a Sn-rich s phase and a Sn-rich L phase, which is the coarsened phase of the s phase, the shape memory properties tend to change easily. The s and L phases are Sn-rich phases and can give precipitates such as γCuSn, δCuSn, and εCuSn with progress of eutectoid transformation. Because Cu—Sn alloys undergo significant changes in their properties with time, such as significant changes in transformation temperatures upon being left to stand at a relatively low temperature near room temperature, Cu—Sn alloys have been subject of basic research but not practical applications. As such, copper alloys that undergo reverse transformation in a high temperature range of about 500° C. to 700° C. and stress-induced martensitic transformation have not achieved the practical use so far.

The disclosure has been made to address these issues. A main object thereof is to provide a novel Cu—Sn copper alloy that stably exhibits shape memory properties and to provide a method for producing same.

Solution to Problem

The copper alloy and method for producing same disclosed in the present description have taken the following measures to achieve the main object described above.

A copper alloy disclosed in the present description has a basic alloy composition represented by $Cu_{100-(x+y)}Sn_xMn_y$ (where $8 \leq x \leq 16$ and $2 \leq y \leq 10$ are satisfied), in which a main phase is a βCuSn phase with Mn dissolved therein, and the βCuSn phase undergoes martensitic transformation when heat-treated or worked.

A method for producing a copper alloy disclosed in the present description is a method for producing a copper alloy that undergoes martensitic transformation when heat-treated or worked. Among a casting step of melting and casting a raw material containing Cu, Sn, and Mn and having a basic alloy composition represented by $Cu_{100-(x+y)}Sn_xMn_y$ (where $8 \leq x \leq 16$ and $2 \leq y \leq 10$ are satisfied) so as to obtain a cast material, and a homogenization step of homogenizing the cast material in a temperature range of a βCuSn phase so as to obtain a homogenized material, the method includes at least the casting step.

Advantageous Effects of Disclosure

The copper alloy and method for producing same according to the present disclosure can provide a novel Cu—Sn copper alloy that stably exhibits shape memory properties and a method for producing same. The reason behind such effects is presumably as follows. For example, the additive element Mn presumably further stabilizes the β phase of the alloy at room temperature. In addition, addition of Mn presumably suppresses slip deformation caused by dislocation and inhibits plastic deformation, thereby further improving the recovery rate.

BRIEF DESCRIPTION OF THE DRAWINGS

FIGS. 30A to 30E show TEM observation results of Experimental Example 7

DETAILED DESCRIPTION OF THE INVENTION

[Copper Alloy]

Figure 1:
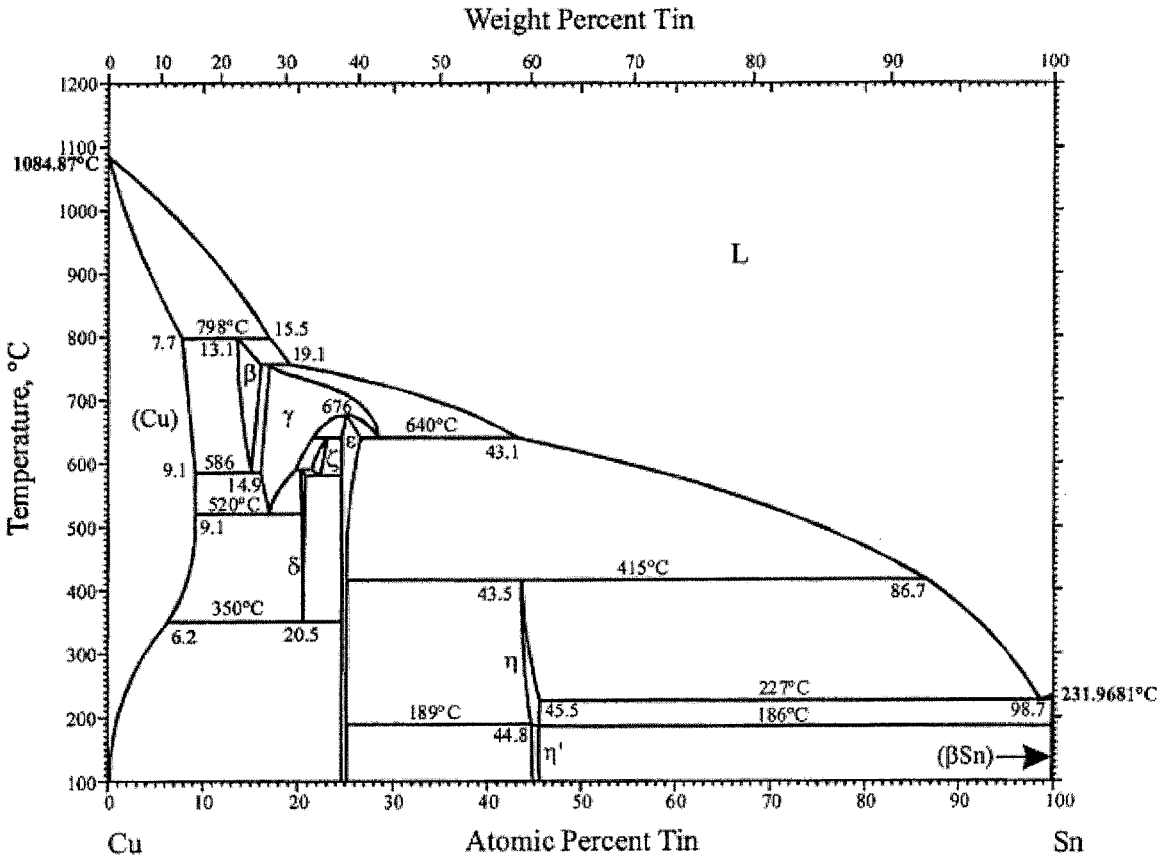
FIG. 1 is an experimental binary phase diagram of CuSn alloys.

The copper alloy disclosed in the present description has a basic alloy composition represented by $Cu_{100-(x+y)}Sn_xMn_y$ (where $8 \leq x \leq 16$ and $2 \leq y \leq 10$ are satisfied), a main phase thereof is a βCuSn phase with Mn dissolved therein, and the βCuSn phase undergoes martensitic transformation when heat-treated or worked. Here, the main phase refers to the phase that accounts for the largest proportion in the entirety. For example, the main phase may be a phase that accounts for 50% by mass or more, may be a phase that accounts for 80% by mass or more, or may be a phase that accounts for 90% by mass or more. In the copper alloy, the βCuSn phase accounts for 95% by mass or more and more preferably 98% by mass or more. The copper alloy may be treated at a temperature of 500° C. or higher and then cooled, and may have at least one selected from a shape memory effect and a super elastic effect at a temperature equal to or lower than the melting point. Since the main phase of the copper alloy is the βCuSn phase, a shape memory effect or a super elastic effect can be exhibited. Alternatively, the area ratio of the βCuSn phase contained in the copper alloy may be in the range of 50% or more and 100% or less in surface observation. The main phase may be determined by surface observation as such. The area ratio of the βCuSn phase may be 95% or more and is more preferably 98% or more. The copper alloy most preferably contains the βCuSn phase as a single phase, but may contain other phases.

The copper alloy may contain 8 at % or more and 16 at % or less of Sn, 2 at % or more and 10 at % or less of Mn, and the balance being Cu and unavoidable impurities. When 2 at % or more of Mn is contained, the self recovery rate can be further increased. When 10 at % or less of Mn is contained, the decrease in electrical conductivity and the decrease in self recovery rate can be further suppressed. The Mn content is preferably not less than 2.5 at %, and more preferably not less than 3.0 at %. The Mn content is preferably not more than 8.3 at %, and more preferably not more than 7.5 at %. When 8 at % or more of Sn is contained, the self recovery rate can be further increased. When 16 at % or less of Sn is contained, the decrease in electrical conductivity and the decrease in self recovery rate can be further suppressed. The Sn content is preferably not less than 10 at %, and more preferably not less than 12 at %. The Sn content is preferably not more than 15 at %, and more preferably not more than 14 at %. Examples of the unavoidable impurities can be at least one selected from Fe, Pb, Bi, Cd, Sb, S, As, Se, and Te, and the total amount of the unavoidable impurities is preferably 0.5 at % or less, more preferably 0.2 at % or less, and yet more preferably 0.1 at % or less.

The elastic recovery (%) of the copper alloy determined from an angle $\theta_1$ observed when a flat plate of the copper alloy is unloaded after being bent at a bending angle of $\theta_0$ is preferably 40% or more. The preferable elastic recovery for shape memory alloys and super elastic alloys is 40% or more. An elastic recovery of 18% or more indicates that there has been recovery (shape memory properties) induced by reverse transformation of martensite, not mere plastic deformation. The elastic recovery is preferably high, for example, is preferably 45% or more and more preferably 50% or more. The bending angle $\theta_0$ is to be 90°.

$$\text{Elastic recovery } R_E\ [\%] = (1-\theta_1/\theta_0)\times 100 \quad \text{(mathematical formula 1)}$$

The thermal recovery (%) of the copper alloy obtained from an angle $\theta_2$ observed when a flat plate of the copper alloy is heated to a particular recovery temperature, which is determined on the basis of the βCuSn phase, after being bent at a bending angle of $\theta_0$ is preferably 40% or more. The preferable thermal recovery of shape memory alloys and super elastic alloys is 40% or more. The thermal recovery may be determined from the formula below by using the aforementioned angle $\theta_1$ observed at the time of unloading. The thermal recovery is preferably high, for example, preferably 45% or more and more preferably 50% or more. The heat treatment for recovery is preferably conducted in the range of 500° C. or higher and 800° C. or lower, for example. The time for the heat treatment depends on the shape and size of the copper alloy, and may be a short time, for example, 10 seconds or shorter.

$$\text{Thermal recovery } R_T\,[\%]=(1-\theta_2/\theta_1)\times 100 \quad \text{(mathematical formula 2)}$$

The elastic thermal recovery (%) of the copper alloy determined from an angle $\theta_1$, which is observed when a flat plate of the copper alloy is unloaded after being bent at a bending angle of $\theta_0$, and an angle $\theta_2$, which is observed when the flat plate is further heated to a particular recovery temperature determined on the basis of the βCuSn phase, is preferably 45% or more. The preferable elastic thermal recovery of shape memory alloys and super elastic alloys is 45% or more. The elastic thermal recovery [%] may be determined from the formula below by using the average elastic recovery. A higher elastic thermal recovery rate is more preferable. For example, the elastic thermal recovery is preferably 50% or more, more preferably 60% or more, still more preferably 70% or more, and further preferably 80% or more. The elastic thermal recovery is more preferably not less than 85%, and still more preferably not less than 90%.

The elastic thermal recovery is preferably high, for example, is preferably 50% or more and more preferably 90% or more.

$$\text{Elastic thermal recovery } R_{E+T}\,[\%]=\text{average elastic recovery}+(1-\theta_2/\theta_1)\times(1-\text{average elastic recovery}) \quad \text{(mathematical formula 3)}$$

The copper alloy may be a polycrystal or a single crystal. The copper alloy may have a crystal grain diameter of 100 μm or more. The crystal grain diameter is preferably large, and a single crystal is preferred over a polycrystal. This is because the shape memory effect and the super elastic effect easily emerge. The cast material for the copper alloy is preferably a homogenized material subjected to homogenization. Since the copper alloy after casting sometimes has a residual solidification structure, homogenization treatment is preferably conducted.

The copper alloy may have an Ms point (the start point temperature of martensitic transformation during cooling) and an As point (the start point temperature of reverse transformation from martensite to the βCuSn phase) that change with the Sn and Mn contents. Since the Ms point and the As point of such a copper alloy change according to the Mn content, various properties, such as emergence of various effects, can be easily adjusted.

[Method for Producing Copper Alloy]

The method for producing a copper alloy that undergoes martensitic transformation when heat-treated or worked includes, among a casting step and a homogenization step, at least the casting step.

(Casting Step)

In the casting step, a raw material containing Cu, Sn, and Mn and having a basic alloy composition represented by $Cu_{100-(x+y)}Sn_xMn_y$ (where $8\leq x\leq 16$ and $2\leq y\leq 10$ are satisfied) is melted and casted to obtain a cast material. In this step, the raw material may be melted and casted to obtain a cast material having a βCuSn phase as the main phase. Examples of the raw materials for Cu, Sn, and Mn that can be used include single-metal materials thereof and alloys containing two or more of Cu, Sn, and Mn. The blend ratio of the raw material may be adjusted according to the desired basic alloy composition. In this step, in order to have Mn dissolved in the CuSn phase, the raw materials are preferably added so that the order of melting is Cu, Mn, and then Sn, and casted. The melting method is not particularly limited, but a high frequency melting method is preferred for its efficiency and industrial viability. The casting step is preferably conducted in an inert gas atmosphere such as in nitrogen, Ar, or vacuum. Oxidation of the cast product can be further suppressed. In this step, the raw material is preferably melted in the temperature range of 750° C. or higher and 1300° C. or lower, and cooled at a cooling rate of −50° C./s to −500° C./s from 800° C. to 400° C. The cooling rate is preferably high in order to obtain a stable βCuSn phase. Examples of the cooling methods include air cooling, oil cooling and water cooling, with water cooling being preferable.

(Homogenization Step)

In the homogenization step, the cast material is homogenized within the temperature range of the βCuSn phase to obtain a homogenized material. In this step, the cast material is preferably held in the temperature range of 600° C. or higher and 850° C. or lower and then cooled at a cooling rate of −50° C./s to −500° C./s. The cooling rate is preferably high in order to obtain a stable βCuSn phase. The homogenization temperature is, for example, preferably 650° C. or higher and more preferably 700° C. or higher. The homogenization temperature is preferably 800° C. or lower and more preferably 750° C. or lower. The homogenization time may be, for example, 20 minutes or longer or 30 minutes or longer. The homogenization time may be, for example, 48 hours or shorter or 24 hours or shorter. The homogenization treatment is also preferably conducted in an inert atmosphere such as in nitrogen, Ar, or vacuum.

(Other Steps)

After the casting step or the homogenization step, other steps may be performed. For example, the method for producing a copper alloy may further include at least one working step of cold-working or hot-working at least one selected from a cast material and a homogenized material into at least one shape selected from a plate shape, a foil shape, a bar shape, a line shape, and a particular shape. In this working step, hot working may be conducted in the temperature range of 500° C. or higher and 700° C. or lower and then cooling may be conducted at a cooling rate of −50° C./s to −500° C./s. In the working step, working may be conducted by a method that suppresses occurrence of shear deformation so that a reduction in area is 50% or less. Alternatively, the method for producing a copper alloy may further include an aging step of subjecting at least one selected from the cast material and the homogenized material to an age hardening treatment so as to obtain an age-hardened material. Alternatively, the method for producing a copper alloy may further include an ordering step of subjecting at least one selected from the cast material and the homogenized material to an ordering treatment so as to obtain an ordered material. In this step, the age-hardening treatment or the ordering treatment may be conducted in the temperature range of 100° C. or higher and 400° C. or lower for a time period of 0.5 hours or longer and 24 hours or shorter.

The present disclosure described in detail above can provide a novel Cu—Sn copper alloy that stably exhibits the shape memory properties and a method for producing same. The reason behind these effects is, for example, presumed to be as follows. For example, the additive element Mn presumably makes the β phase of the alloy more stable at room temperature. Moreover, addition of Mn presumably suppresses slip deformation caused by dislocation and inhibits plastic deformation, thereby further improving the recovery rate.

The present disclosure is not limited to the above-described embodiment, and can be carried out by various modes as long as they belong to the technical scope of the disclosure.

EXAMPLES

In the description below, examples in which copper alloys were actually produced are described as experimental examples.

CuSn alloys have excellent castability and are considered to rarely undergo eutectoid transformation, which is one cause for degradation of shape memory properties, because the eutectic point of βCuSn is high. In the present disclosure, inducing emergence of and controlling the shape memory properties by adding a third additive element X (Mn) to CuSn alloys were attempted.

Experimental Example 1

Figure 2:
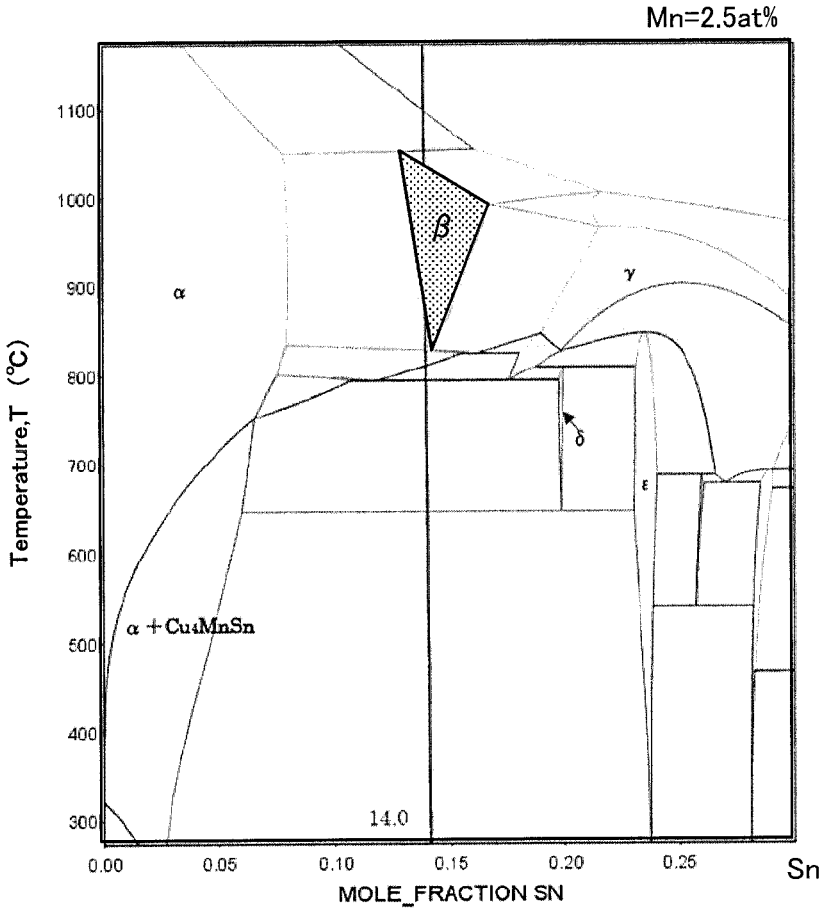
FIG. 2 is a calculated phase diagram of CuSnMn alloy with Mn=2.5 at %.
Figure 3:
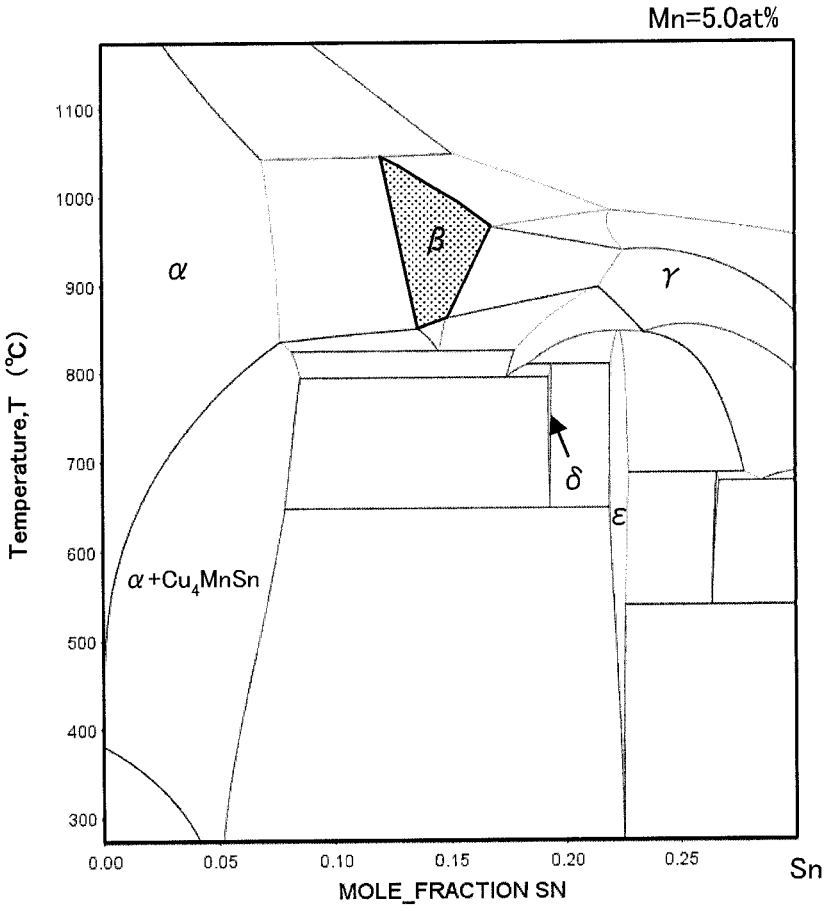
FIG. 3 is a calculated phase diagram of CuSnMn alloy with Mn=5.0 at %.
Figure 4:
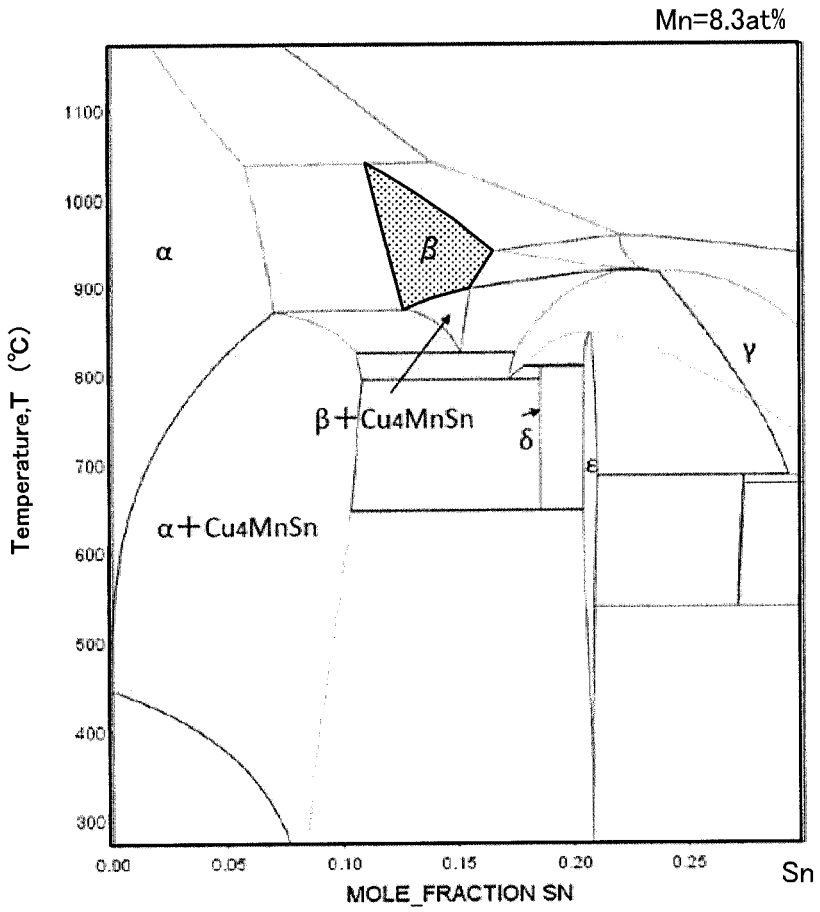
FIG. 4 is a calculated phase diagram of CuSnMn alloy with Mn=8.3 at %.

A Cu—Sn—Mn alloy was prepared. With reference to a Cu—Sn binary phase diagram (FIG. 1), a composition with which a βCuSn single phase was formed as the constituent phase of the subject sample at high temperature was set to be the target composition. The phase diagram referred is an experimental phase diagram derived from ASM International DESK HANDBOOK Phase Diagrams for Binary Alloys, Second Edition (5) and ASM International Handbook of Ternary Alloy Phase Diagrams. Use was also made of a calculated phase diagram drawn with Thermo-Calc that is a software which creates an equilibrium diagram by the CALPHAD method. FIGS. 2 to 4 are calculated phase diagrams of CuSnMn alloys with Mn=2.5 at %, 5.0 at % and 8.3 at %, respectively. Pure Cu, pure Sn, and pure Mn were weighed so that the molten alloy would have a composition close to the target composition, and then alloy samples were prepared by melting and casting the raw material while blowing $N_2$ gas in an air high-frequency melting furnace. The target composition was set to $Cu_{100-(x+y)}Sn_xMn_y$ (x=14, 13, y=2.5, 4.9), and the order of melting was set to Cu→Mn→Sn. Since melted and casted samples have solidification structures and are inhomogeneous as are, a homogenization treatment was conducted. During this process, in order to prevent oxidation, samples were vacuum-sealed in quartz tubes, held at 750° C. (973 K) for 30 minutes in a muffle furnace, and rapidly cooled by placing the tubes in ice water while breaking the quartz tubes at the same time. The basic alloy composition with x=14 and y=2.5 was Experimental Example 1, and that with X=13 and y=4.9 was Experimental Example 2.

(Optical Microscope Observation)

The alloy ingot was cut to a thickness of 0.2 to 0.3 mm with a fine cutter and a micro cutter, and the cut piece was mechanically polished with a rotating polisher equipped with waterproof abrasive paper No. 100 to 2000. Then the resulting piece was buff-polished with an alumina solution (alumina diameter: 0.3 μm), and a mirror surface was obtained as a result. Since optical microscope observation samples were also handled as bending test samples, the sample thickness was made uniform and then the samples were heat-treated (supercooled high-temperature phase formation treatment). The sample thickness was set to 0.1 mm. In the optical microscope observation, a digital microscope, VH-8000 produced by Keyence Corporation was used. The possible magnification of this device was 450× to 3000×, but observation was basically conducted at a magnification of 450×.

(X-Ray Powder Diffraction Measurement: XRD)

XRD measurement samples were prepared as follows. The alloy ingot was cut with a fine cutter, and edges were filed with a metal file to obtain a powder sample. The sample was heat-treated to prepare an XRD measurement sample. In quenching, the quartz tube was left unbroken during cooling since if the quartz tube was caused to break in water as with normal samples, the powder sample may contain moisture and may become oxidized. The XRD diffractometer used was RINT2500 produced by Rigaku Corporation. The diffractometer was a rotating-anode X-ray diffractometer. The measurement was conducted under the following conditions: rotor target serving as rotating anode: Cu, tube voltage: 40 kV, tube current: 200 mA, measurement range: 10° to 120°, sampling width: 0.02°, measurement rate: 2°/minute, divergence slit angle: 1°, scattering slit angle: 1°, receiving slit width: 0.3 mm. In data analysis, a powder diffraction analysis software suite Rigaku PDXL was used to analyze the peaks emerged, identify the phases, and calculate the phase volume fractions. Note that PDXL employs the Hanawalt method for peak identification.

(Transmission Electron Microscope Observation: TEM)

TEM observation samples were prepared as follows. The melted and casted alloy ingot was cut with a fine cutter and a micro cutter to a thickness of 0.2 to 0.3 mm, and the cut piece was mechanically polished with a rotating polisher equipped with a No. 2000 waterproof abrasive paper to a thickness of 0.15 to 0.25 mm. This thin-film sample was shaped into a 3 mm square, heat-treated, and electrolytically polished under the following conditions. In electrolytic polishing, nital was used as the electrolytic polishing solution, and jet polishing was conducted while keeping the temperature at about −20° C. to −10° C. (253 to 263 K). The electrolytic polisher used was TenuPol produced by STRUERS, and polishing was conducted under the following conditions: voltage: 5 to 10 V, current: 0.5 A, flow rate: 2.5. The electrolytic polishing was performed in two stages, specifically, an oxide film was formed in the first 30 seconds from the start of polishing, and the oxide film was removed during the rest of the polishing. The sample was observed immediately after completion of electrolytic polishing. In TEM observation, Hitachi H-800 (side entry analysis mode) TEM (accelerating voltage: 175 kV) was used. Further, in-situ TEM observation was also performed using a uniaxial tensile holder. The in-situ tensile observation involved H-5001T sample tensile holder attached to the H-800 apparatus. In in-situ heating observation, a heating holder attached to the H-800 apparatus was used.

(Macroscopic Observation of Shape Memory Properties: Bending Test)

The alloy ingot was cut with a fine cutter and a micro cutter to a thickness of 0.3 mm, and the cut piece was mechanically polished with a rotating polisher equipped with waterproof abrasive paper No. 100 to 2000 so that the thickness was 0.15 mm. The thickness was set to 0.15 mm because Cu—Sn—Mn with 0.1 mm thickness would show elastic recovery and no martensite would be observed during bending deformation. The same treatment as that for the sample for the optical microscope observation was conducted, and the sample after the heat treatment was wound around a guide having R=0.75 mm. Then bending deformation was applied by bending the sample at a bending angle of 90°. The bending angle was 90° because Cu—Sn—Mn bent at 45° would show elastic recovery and no martensite would be observed during bending deformation. The bending angle $\theta_0$ (90°) of the sample, the angle $\theta_1$ after unloading, and the angle $\theta_2$ after the heat treatment at 750° C. (1023

Figure 5:
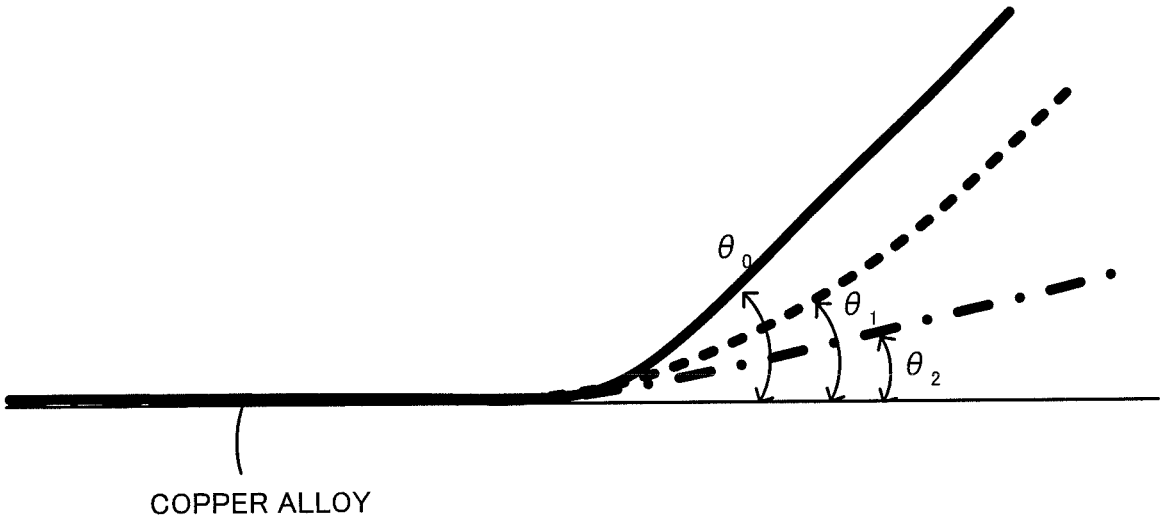
FIG. 5 is a diagram illustrating angles involved in recovery rate measurement

K) for 1 minute were measured, and the elastic recovery and the thermal recovery were determined from the following formulae. A recovery-temperature curve was also obtained by changing the heating temperature after deformation. In obtaining the recovery-temperature curve, since the stress applied during bending cannot be made uniform among the samples, the angles (elastic recovery) of the samples at the time of unloading are likely to vary. Thus, the elastic+thermal recovery was determined from the following formula by correcting the thermal recovery on the basis of the average value of the elastic recovery. FIG. 5 is a diagram illustrating angles involved in recovery measurement.

$$\text{Elastic recovery [\%]}=(1-\theta_1/\theta_0)\times 100 \quad \text{(mathematical formula 1)}$$

$$\text{Thermal recovery [\%]}=(1-\theta_2/\theta_1)\times 100 \quad \text{(mathematical formula 2)}$$

$$\text{Elastic+thermal recovery [\%]}=\text{average elastic recovery}+(1-\theta_2/\theta_1)\times(1-\text{average elastic recovery}) \quad \text{(mathematical formula 3)}$$

Figure 6A:
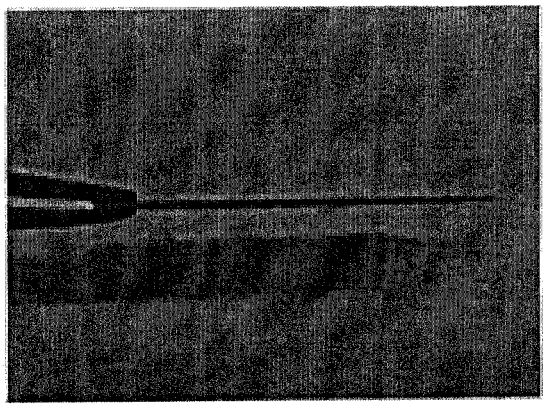
FIGS. 6A to 6C show macroscopic observation results of shape memory properties of an alloy foil of Experimental Example 1.
Figure 6B:
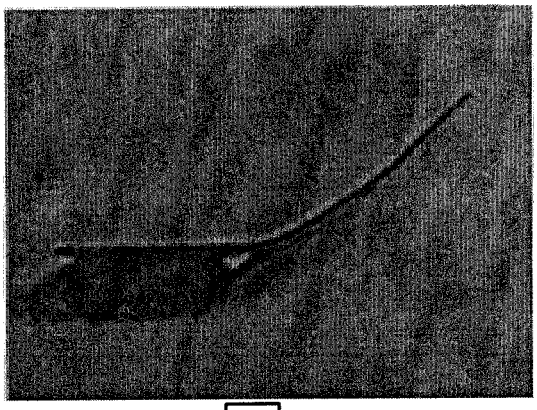
Figure 6C:
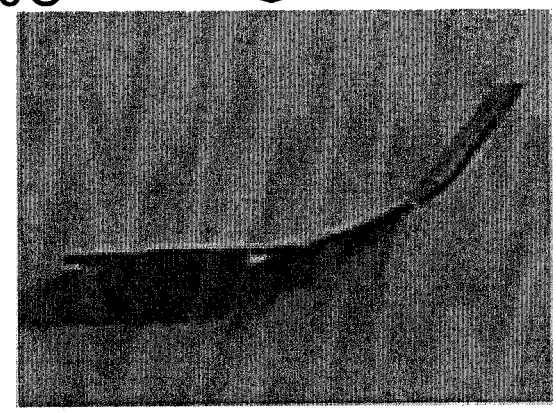
Figure 7A:
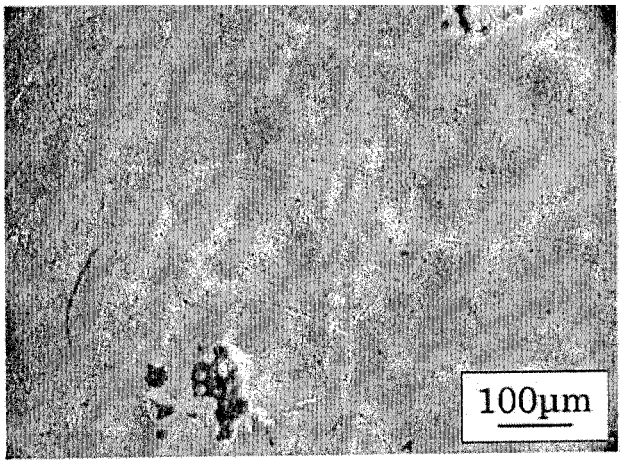
FIGS. 7A to 7C show optical microscope observation results of the alloy foil of Experimental Example 1.
Figure 7B:
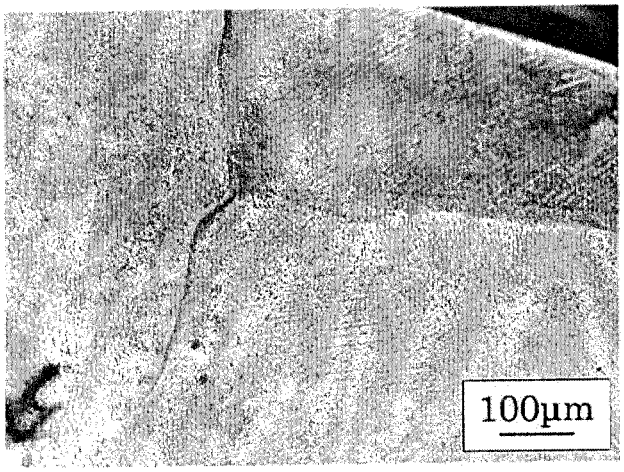
Figure 7C:
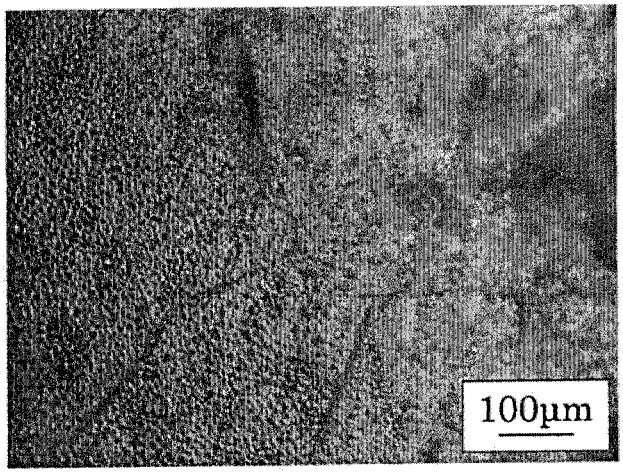
Figure 8:
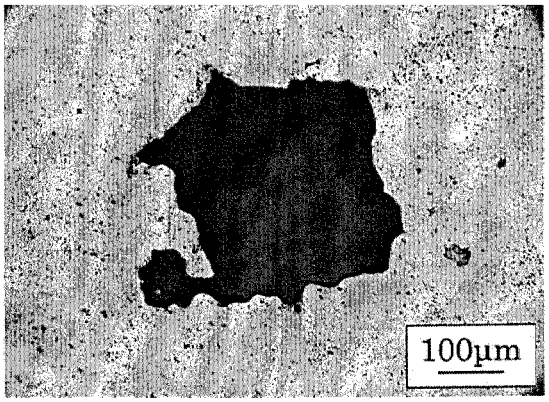
FIG. 8 shows optical microscope observation results of a cast structure of Experimental Example 1.
Figure 9:
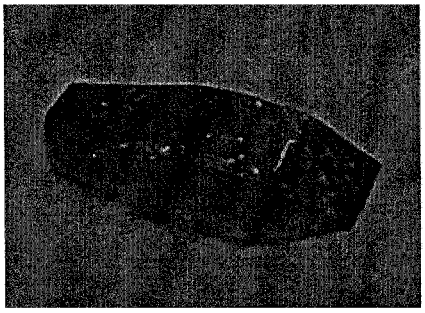
FIG. 9 is a photograph of cracking during deformation in Experimental Example 1.

The structure of the homogenized sample was observed after the treatment, during deformation, and after heat treatment (unloading). FIGS. 6A to 6C show macroscopic observation results of the shape memory properties of the alloy foil of Experimental Example 1. FIG. 6A is a photograph taken after the homogenization treatment, FIG. 6B is a photograph taken during bending deformation, and FIG. 6C is a photograph taken after thermal recovery. FIGS. 7A to 7C show optical microscope observation results of the alloy foil of Experimental Example 1. FIG. 7A is a photograph taken after the homogenization treatment, FIG. 7B is a photograph taken during bending deformation, and FIG. 7C is a photograph taken after thermal recovery. FIG. 8 shows the optical microscope observation results of the cast structure of Experimental Example 1. FIG. 9 is a photograph of cracking during deformation in Experimental Example 1. As shown in FIG. 6B, when the sample of Experimental Example 1 was deformed by bending, permanent strain remained; as shown in FIG. 6C, the shape was recovered slightly when the sample was heat-treated at 700° C. (973 K) for 1 minute. Martensite was not seen after the homogenization treatment (FIG. 7A), but stress-induced martensite was seen during deformation (FIG. 7B). After the heat treatment, the stress-induced martensite was extinct (FIG. 7C). In this sample, many bubbles with 300 μm diameter were found even after the homogenization treatment (FIG. 8). The sample was cracked from the bubble portion during bending deformation (FIG. 9).

Figure 10A:
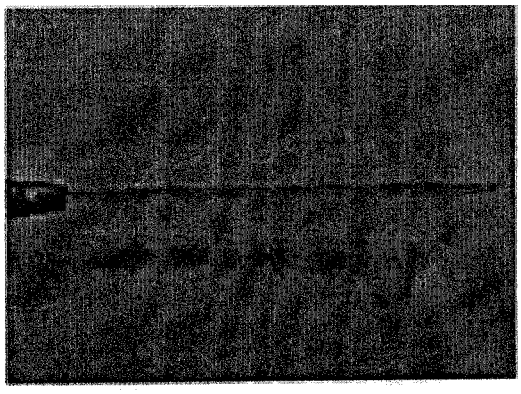
FIGS. 10A to 10C show macroscopic observation results of shape memory properties of an alloy foil of Experimental Example 2.
Figure 10B:
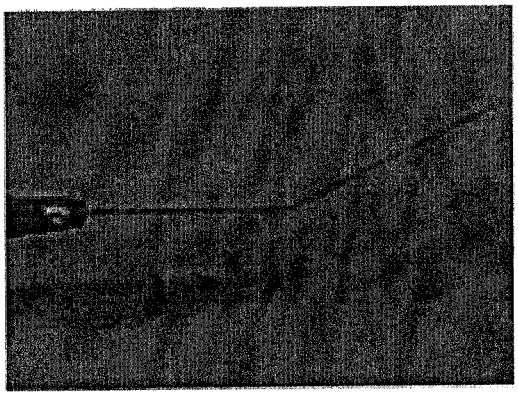
Figure 10C:
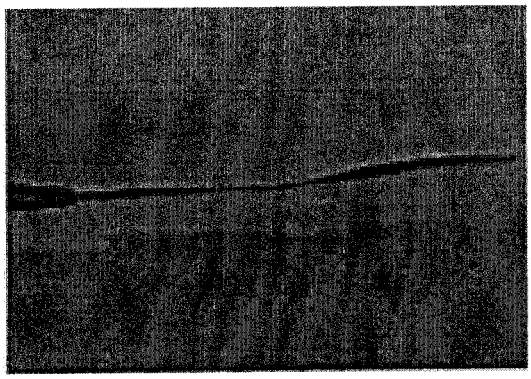
Figure 11A:
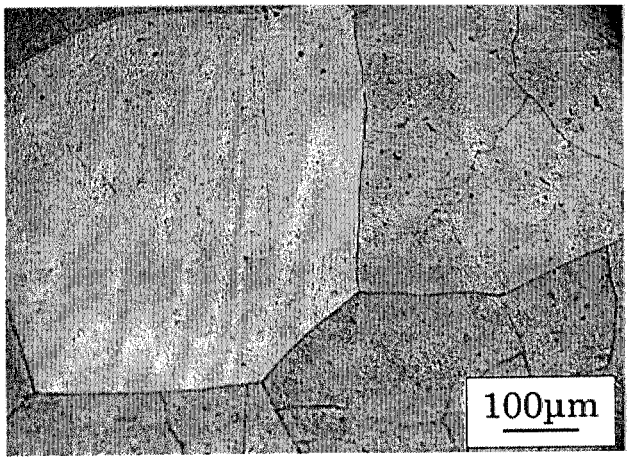
FIGS. 11A to 11C show optical microscope observation results of the alloy foil of Experimental Example 2.
Figure 11B:
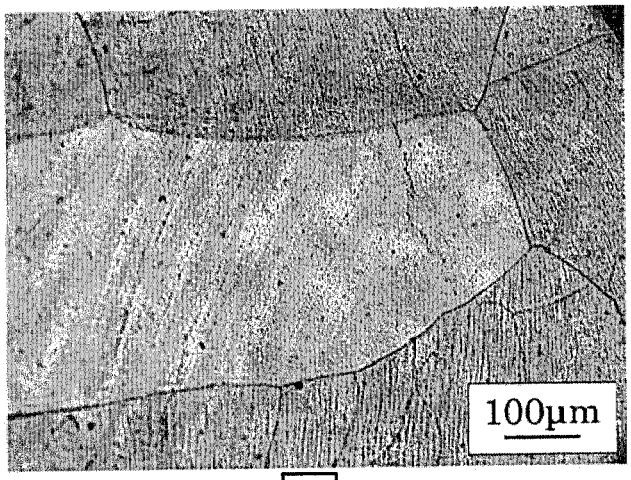
Figure 11C:
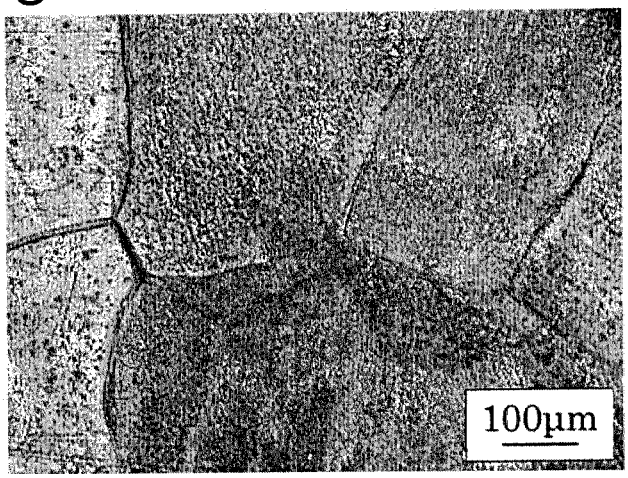
Figure 12:
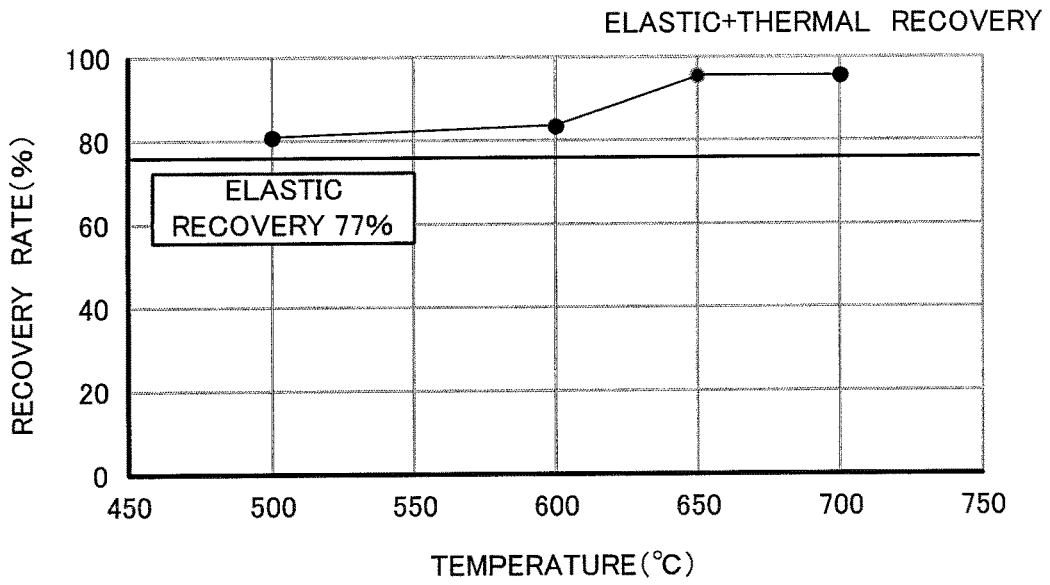
FIG. 12 is a graph showing the relationship between the temperatures and the elastic thermal recovery of Experimental Example 2.
Figure 13:
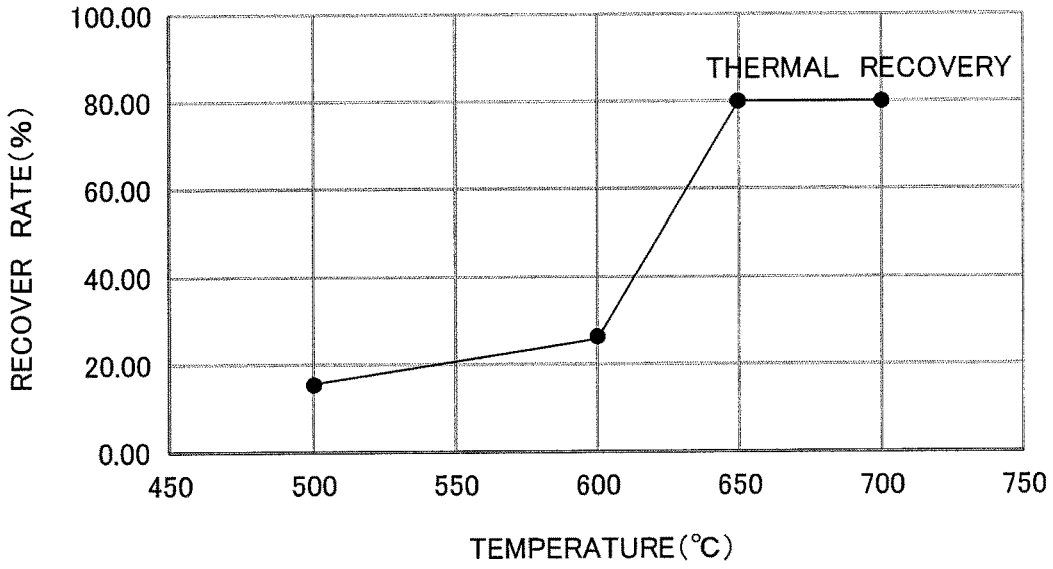
FIG. 13 is a graph showing the relationship between the temperatures and the thermal recovery of Experimental Example 2.

FIGS. 10A to 10C show the macroscopic observation results of shape memory properties of the alloy foil of Experimental Example 2. FIGS. 11A to 11C show the optical microscope observation results of the alloy foil of Experimental Example 2. As shown in FIG. 10B, when the sample of Experimental Example 2 was deformed by bending, permanent strain remained; as shown in FIG. 10C, the shape was recovered when the sample was heat-treated at 700° C. (973 K) for 1 minute. While there was no martensite after the homogenization treatment (FIG. 11A), stress-induced martensite was seen during deformation (FIG. 11B). After the heat treatment, the stress-induced martensite was almost extinct (FIG. 11(*c*)). FIG. 12 is a graph showing the relationship between temperatures and the elastic+thermal recovery of Experimental Example 2. FIG. 13 is a graph showing the relationship between temperatures and the thermal recovery rate of Experimental Example 2. Table 1 summarizes the measurement results of Experimental Example 2. In Experimental Example 2, the elastic recovery was 77%, and the samples significantly recovered the shape when heat-treated at 500° C. (773 K) or above (FIG. 13), and the elastic+thermal recovery reached 95% (FIG. 12).

TABLE 1

| | Measured Temperature | | Permanent Deformation Thermal Recovery | Elastic Recovery | Average Elastic Permanent Deformation Thermal Recovery |
|---|---|---|---|---|---|
| | ° C. | K | % | % | % |
| Experimental Example 2 | 20 | 293 | 0 | | 77.22 |
| | 500 | 773 | 15.38 | 85.56 | 80.73 |
| | 600 | 873 | 26.32 | 78.89 | 83.22 |
| | 650 | 923 | 80.00 | 72.22 | 95.44 |
| | 700 | 973 | 80.00 | 72.22 | 95.44 |
| | Average Elastic Recovery (%) | | | 77.22 | |
| | Average Permanent Deformation (%) | | | 22.78 | |

Experimental Example 3

Figure 14A:
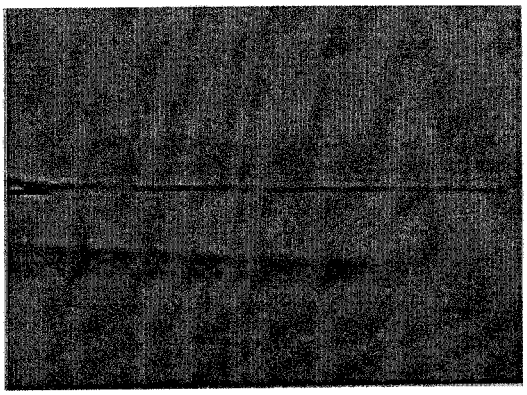
FIGS. 14A to 14C show macroscopic observation results of shape memory properties of an alloy foil of Experimental Example 3.
Figure 14B:
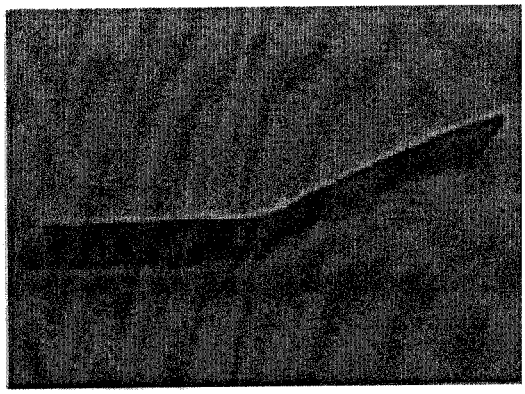
Figure 14C:
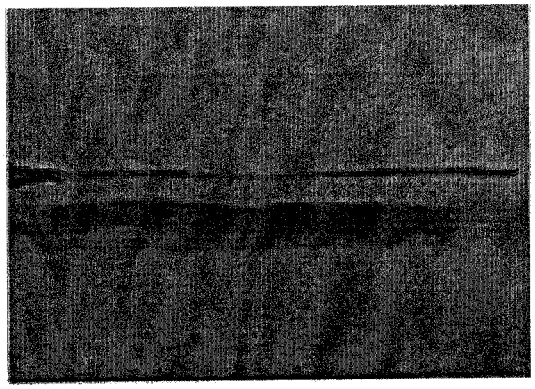
Figure 15A:
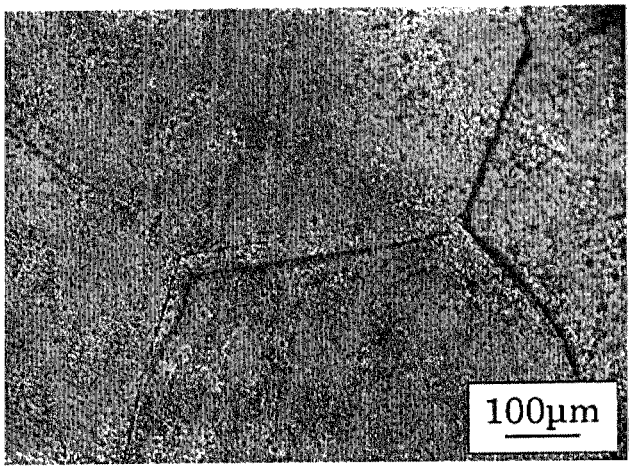
FIGS. 15A to 15C show optical microscope observation results of the alloy foil of Experimental Example 3.
Figure 15B:
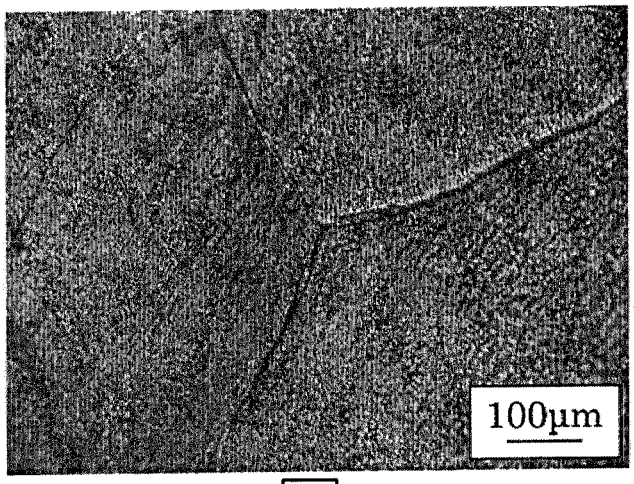
Figure 15C:
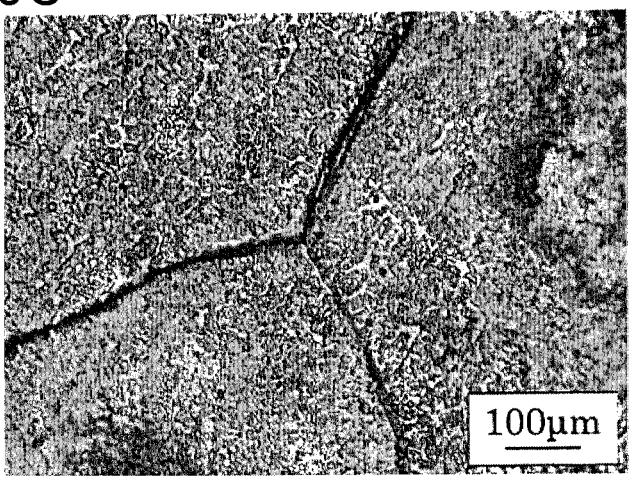
Figure 16:
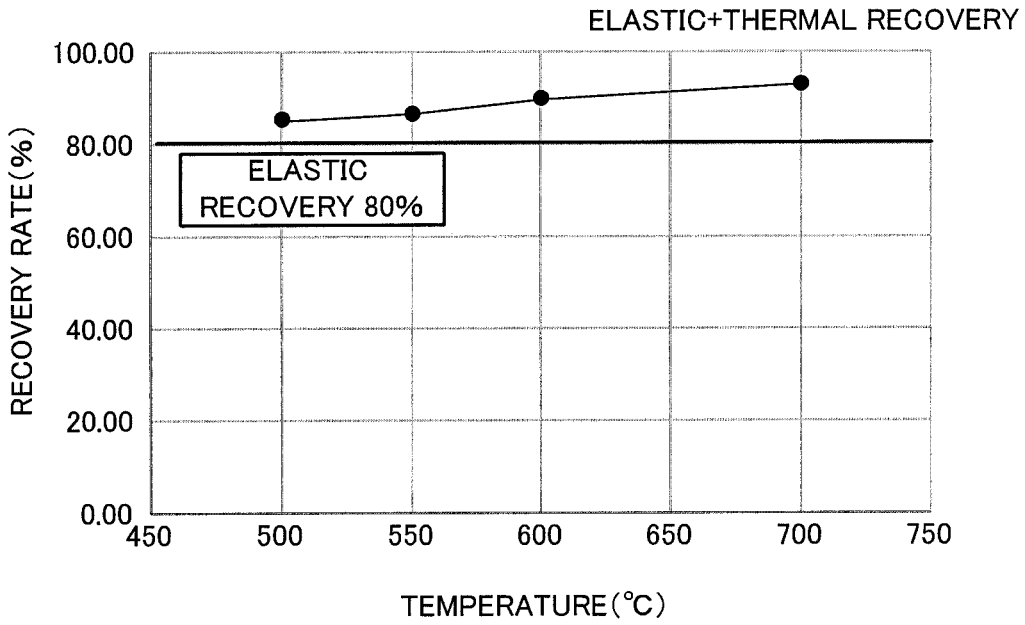
FIG. 16 is a graph showing the relationship between the temperatures and the elastic thermal recovery of Experimental Example 3.
Figure 17:
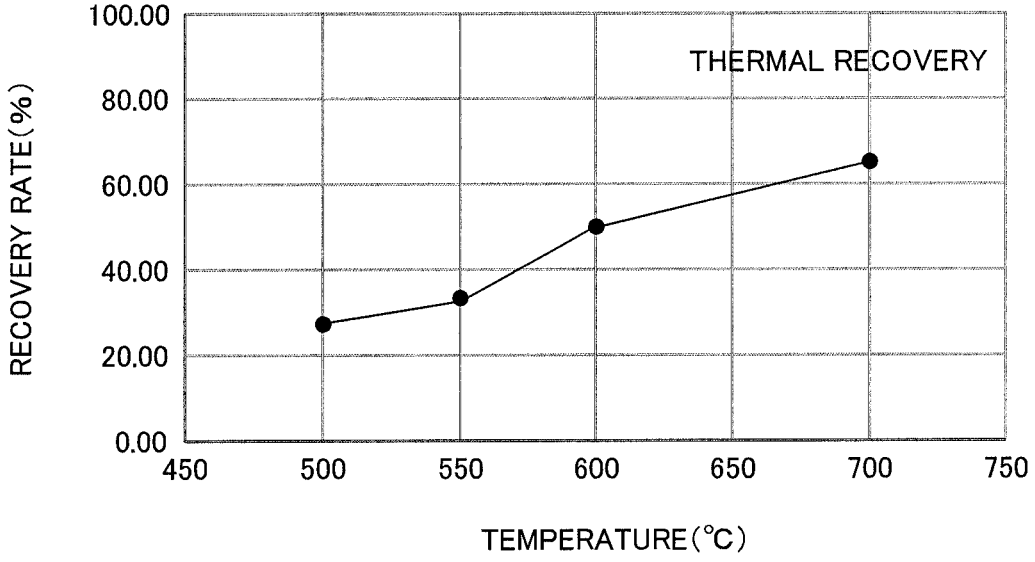
FIG. 17 is a graph showing the relationship between the temperatures and the thermal recovery of Experimental Example 3.

The copper alloy of Experimental Example 2 was aged at room temperature for 10,000 minutes to prepare Experimental Example 3. The same measurement was conducted on Experimental Example 3 as in Experimental Example 1. FIGS. 14A to 14C show macroscopic observation results of the shape memory properties of the alloy foil of Experimental Example 3. FIG. 14A is a photograph taken after the homogenization treatment, FIG. 14B is a photograph taken during bending deformation, and FIG. 14C is a photograph taken after thermal recovery. FIGS. 15A to 15C show the optical microscope observation results of the alloy foil of Experimental Example 3. FIG. 15A is a photograph taken after the homogenization treatment, FIG. 15B is a photograph taken during bending deformation, and FIG. 15C is a photograph taken after thermal recovery. As shown in FIG. 14B, when the sample of Experimental Example 3 was deformed by bending, permanent strain remained; as shown in FIG. 14C, the shape was recovered when the sample was heat-treated at 700° C. (973 K) for 1 minute. While there was no martensite after the homogenization treatment (FIG. 15A), stress-induced martensite was seen during deformation (FIG. 15B). After the heat treatment, the stress-induced martensite was extinct (FIG. 15C). FIG. 16 is a graph showing the relationship between temperatures and the elastic+thermal recovery of Experimental Example 3. FIG. 17 is a graph showing the relationship between temperatures and the thermal recovery of Experimental Example 3. Table 2 summarizes the measurement results of Experimental Example 3. In Experimental Example 3, the elastic recovery was 80%, and the samples significantly recovered the shape when heat-treated at 500° C. (773 K) or above (FIG. 17), and the elastic+thermal recovery reached 93% (FIG. 16).

As shown in FIGS. 14 and 15, in Experimental Example 3 also, elastic recovery occurred and recovery was significant when the heat treatment was conducted. In other words, it was found that the shape memory properties were maintained even when the sample was aged at room temperature.

TABLE 2

| | Measured Temperature | | Permanent Deformation Thermal Recovery | Elastic Recovery | Average Elastic Permanent Deformation Thermal Recovery |
|---|---|---|---|---|---|
| | ° C. | K | % | % | % |
| Experimental Example 3 | 20 | 293 | 0 | | 80.00 |
| | 500 | 773 | 27.27 | 87.78 | 85.45 |
| | 550 | 823 | 33.33 | 83.33 | 86.67 |
| | 600 | 873 | 50.00 | 82.22 | 90.00 |
| | 700 | 973 | 65.22 | 74.44 | 93.04 |
| | Average Elastic Recovery (%) | | | 80.00 | |
| | Average Permanent Deformation (%) | | | 20.00 | |

(Discussions)

In Experimental Example 1, the sample exhibited the shape memory effect; while there was no martensite after the homogenization treatment, stress-induced martensite was seen during deformation. Because the martensite was extinct after the heat treatment, the shape memory effect was probably ascribed to the stress-induced martensite. The sample contained many bubbles with 300 μm diameter as shown in FIG. 8 even after the homogenization treatment, and the sample was cracked from the bubble portion when it was deformed by bending. These bubbles are cast structures and stem from unsuccessful melting and casting. Thus, the accurate measurement of shape recovery of this ingot was difficult. In Experimental Example 2, the sample exhibited the shape memory effect; while there was no martensite after the homogenization treatment, stress-induced martensite was seen during deformation. Because the martensite was almost extinct after the heat treatment, the shape memory effect was probably ascribed to the stress-induced martensite. The average elastic recovery of the samples was 77%, and the samples significantly recovered the shape when heated at 500° C. (773 K) or above, with the elastic+thermal recovery reaching 95%. Compared to Cu-14 at % Sn, the elastic recovery increased from 35% to 77%. It was probable that the addition of Mn suppressed slip deformation caused by dislocation and inhibited plastic deformation. In Experimental Example 3, the sample exhibited the shape memory effect even after room-temperature aging; while there was no martensite after the homogenization treatment, stress-induced martensite was seen during deformation. Because the stress-induced martensite was extinct after the heat treatment, the shape memory effect was probably ascribed to the stress-induced martensite. The average elastic recovery of the samples was 80%, and the samples significantly recovered the shape when heated at 500° C. (773 K) or above, with the elastic+thermal recovery reaching 93%. Compared to Cu-14 at % Sn, the elastic recovery increased from 35% to 80%. It was probable that the addition of Mn suppressed slip deformation caused by dislocation and inhibited plastic deformation.

Figure 18:
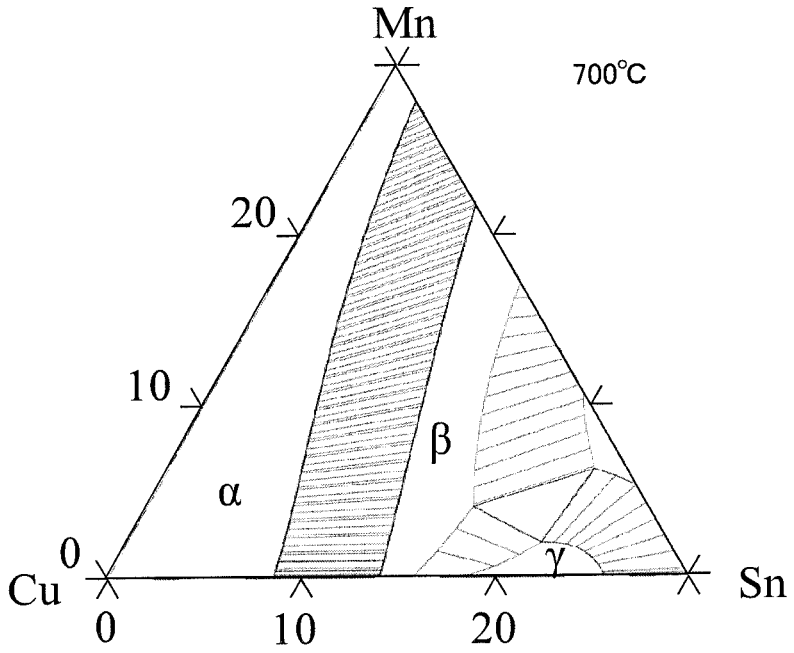
FIG. 18 is a ternary phase diagram of CuSnMn alloy (700° C.)

Kennon has reported the change in shape memory properties of βCuSn by room-temperature aging. The change is considered to be associated with the room-temperature diffusion and precipitation of Sn which can be described as "room-temperature diffusion of Sn induces the precipitation of Sn-rich s phase and L phase which results from the coarsening of s phase". Because the s and L phases are rich in Sn, the precipitates may be eutectoid transformation products (such as γCuSn, δCuSn and εCuSn). Mn is an element that stabilizes βCuSn. Thus, it was assumed that βCuSn was stabilized as a result of Mn being dissolved and the eutectoid transformation was inhibited. FIG. 18 is a ternary phase diagram of CuSnMn alloy (700° C. (973 K)). As shown in FIG. 18, the addition of Mn results in βCuSn in a wide range of composition on the Cu—Sn—Mn phase diagram, and this fact is probably one of the reasons for Mn being a stabilizing element for βCuSn.

Figure 19:
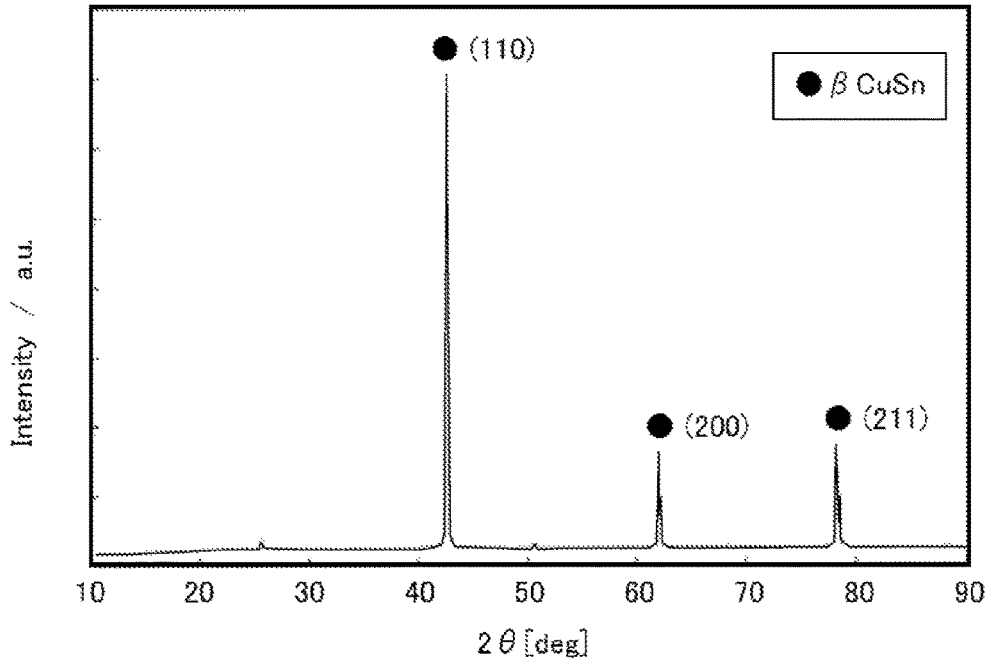
FIG. 19 shows XRD measurement results of Experimental Example 1.
Figure 20:
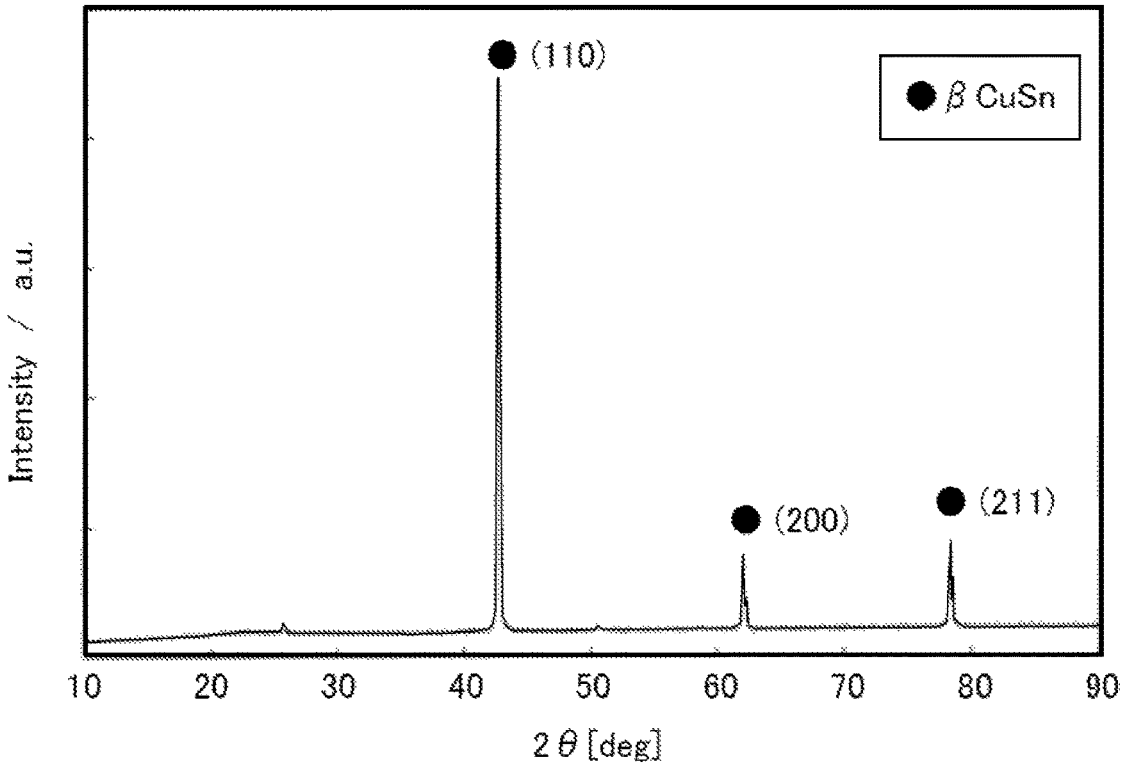
FIG. 20 shows XRD measurement results of Experimental Example 2.
Figure 21:
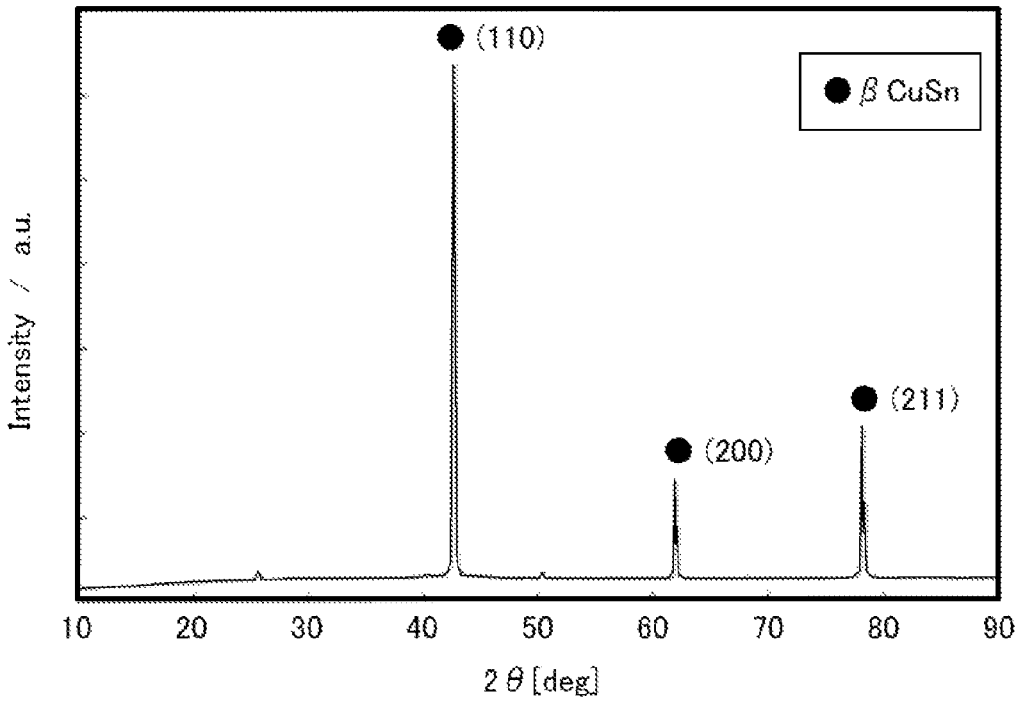
FIG. 21 shows XRD measurement results of Experimental Example 3.

FIG. 19 shows XRD measurement results of Experimental Example 1. The intensity profile of the Experimental Example 1 was analyzed, and it was found that the constituent phase was βCuSn. In other words, almost all of the phases were βCuSn. The lattice constant was 2.99 Å, which was slightly smaller than the literature value, 3.03 Å. FIG. 20 shows XRD measurement results of Experimental Example 2. The intensity profile of the Experimental Example 2 was analyzed, and it was found that the constituent phase was βCuSn. In other words, almost all of the phases were βCuSn. The lattice constant in Experimental Example 2 was also 2.99 Å, which was slightly smaller than the literature value, 3.03 Å. FIG. 21 shows XRD measurement results of Experimental Example 3. The intensity profile of the Experimental Example 3 was analyzed, and it was found that the constituent phase was βCuSn. In other words, almost all of the phases were βCuSn. The lattice constant of Experimental Example 3 was also 2.99 Å, which was slightly smaller than the literature value, 3.03 Å and was not much different from Experimental Example 2. This shows that in the Cu—Sn—Mn copper alloy with Mn dissolved therein, βCuSn is stably present even after passage of time.

The constituent phase in Experimental Example 1 was βCuSn. The results that this sample exhibited slight shape memory effect and stress-induced martensite occurred are reasonable. As explained earlier, the fact that the sample exhibited only slight shape memory effect arose from unsuccessful casting or cracking caused during bending deformation due to the sample containing a large number of cast structures (bubbles). The reasons behind the lattice constant being smaller than the literature value will be discussed in association with the deviation of the sample structure from βCuSn ($Cu_{85}Sn_{15}$). The Cu content of βCuSn ($Cu_{85}Sn_{15}$) that balances with 14 at % Sn contained in Cu-14 at % Sn-2.5 at % Mn is 14/15×85=about 79 at % Cu. This indicates that Cu-14 at % Sn-2.5 at % Mn is βCuSn which is a solid solution containing less Sn and much Cu and Mn. Cu and Mn have smaller atomic radii than Sn. Thus, it is probable that the lattice constant was smaller because Cu and Mn, which have smaller atomic radii than Sn, were dissolved in βCuSn.

The constituent phase of Experimental Example 1 was βCuSn. The result that this sample exhibits the shape memory effect and stress-induced martensite occurred are reasonable. Considerations will now be made on deviation of the sample structure from βCuSn ($Cu_{85}Sn_{15}$), which is assumed to be the reason behind the lattice constant being smaller than the literature value. The Cu content of βCuSn ($Cu_{85}Sn_{15}$) that balances with 13 at % Sn contained in Cu-13 at % Sn-4.9 at % Mn is 13/15×85=about 74 at % Cu; and this indicates that Cu-13 at % Sn-4.9 at % Mn is βCuSn with less Sn and more Cu and Mn dissolved therein. Cu and Mn have smaller atomic radii than Sn. Thus it is considered that the lattice constant was smaller because Cu and Mn, which have smaller atomic radii than Sn, were dissolved in βCuSn. The constituent phase of Experimental Example 3 was βCuSn. The result that this sample exhibits the shape memory effect and stress-induced martensite occurred are reasonable. No significant differences were acknowledged compared to Experimental Example 2.

Figure 22A:
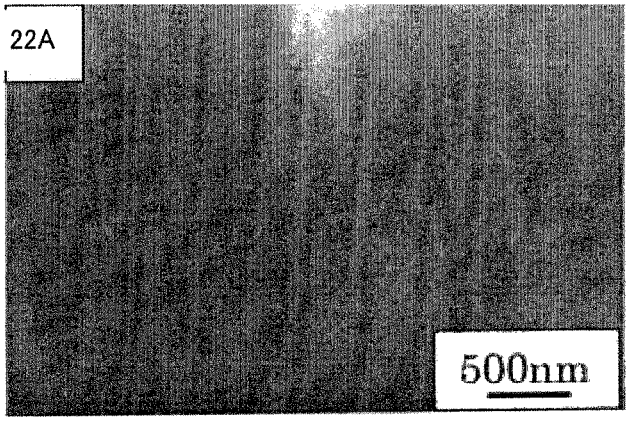
FIGS. 22A and 22B show TEM observation results of Experimental Example 2.
Figure 22B:
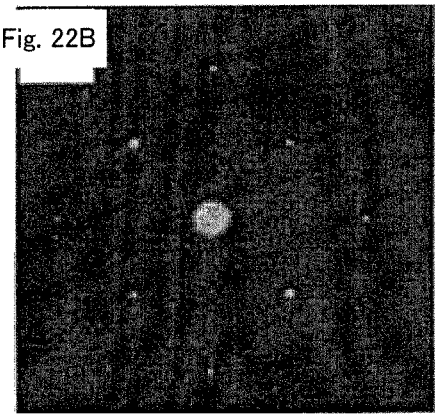
Figure 23A:
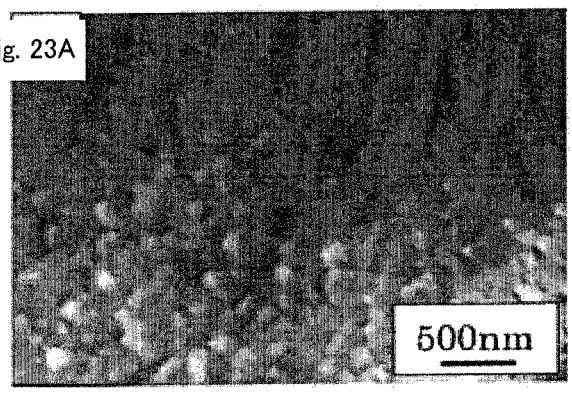
FIGS. 23A to 23D show TEM observation results of a parent phase in Experimental Example 2 with various tensile amounts.
Figure 23B:
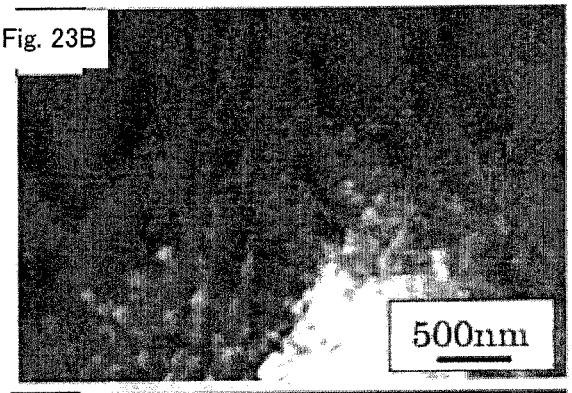
Figure 23C:
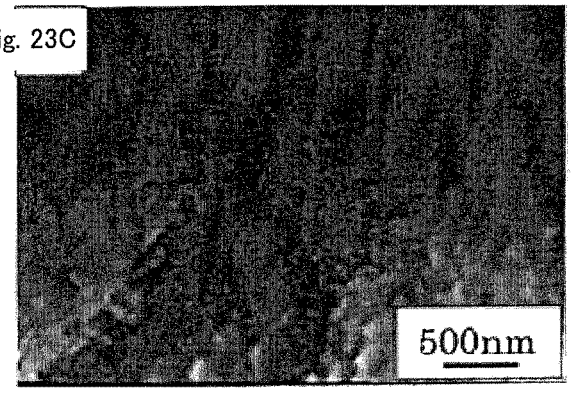
Figure 23D:
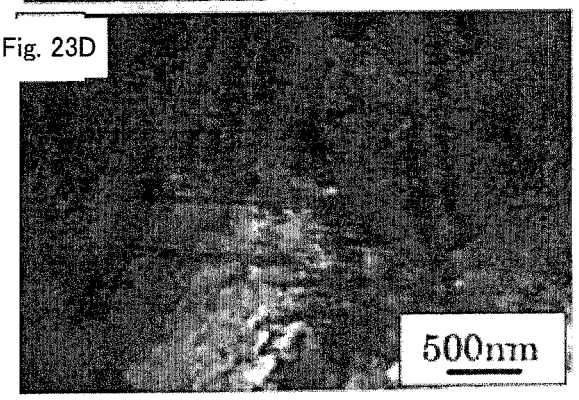
Figure 24A:
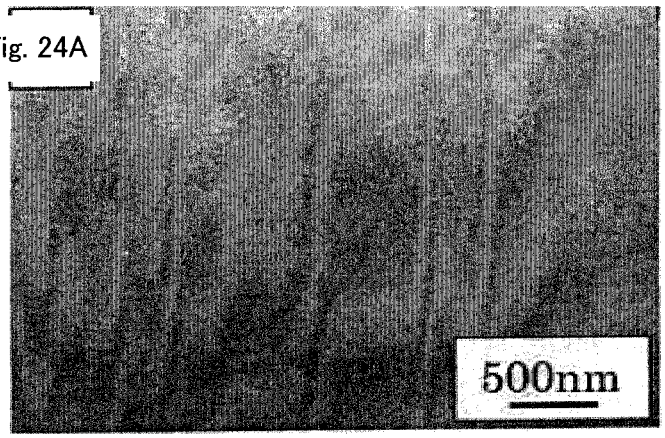
FIGS. 24A and 24B shows TEM observation results of Experimental Example 3.
Figure 24B:
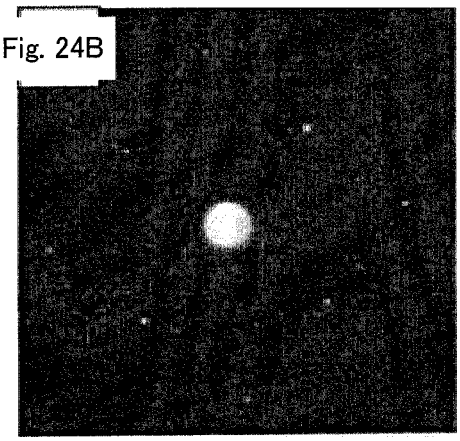

FIGS. 22A and 22B show the TEM observation results of Experimental Example 2. In the electron diffraction pattern of Experimental Example 2, no superfluous wing-shaped diffraction mottles were observed. FIGS. 23A to 23D show the TEM observation results of the parent phase in Experimental Example 2 with various tensile amounts. FIG. 23A is for a tensile amount of 0 mm. FIG. 23B is for a tensile amount of 0.1 mm. FIG. 23C is for a tensile amount of 1.0 mm. FIG. 23D is for a tensile amount of 25 mm. The results shown in FIGS. 23A to 23D are of in-situ tensile observation. Attention is drawn to a central portion of the parent phase in FIG. 23A. As illustrated in FIG. 23B, fine stress-induced martensite occurred when a tensile amount was applied. As illustrated in FIGS. 23C and D, the band length and number of stress-induced martensite were increased with increasing tensile amount. FIGS. 24A and 24B show the TEM observation results of Experimental Example 3. In Experimental Example 3, the electron diffraction pattern had no superfluous wing-shaped diffraction mottles. In Experimental Example 2, the electron diffraction pattern had no superfluous wing-shaped diffraction mottles. Similarly to the optical microscope observation, stress-induced martensite was identified. This stress-induced martensite was probably responsible for the shape memory effect. The aged sample of Experimental Example 3 gave an electron diffraction pattern which contained no superfluous wing-shaped diffraction mottles. This indicates that no precipitation of s phase or L phase was induced by room-temperature aging. This sample shows no change in shape memory properties due to room-temperature aging. From the results described above, it has been shown that Mn is an additive element that inhibits room-temperature aging which is problematic in Cu—Sn shape memory alloys and that is important for attaining stable shape memory effect.

As mentioned earlier, the constituent phase in Experimental Example 2 was βCuSn. In Experimental Examples 2 and 3, the samples exhibited the shape memory effect. The average elastic recovery of the samples was about 80%, and the samples significantly recovered the shape when heated at 500° C. (773 K) or above, with the elastic+thermal recovery reaching more than 90%. Compared to Cu-14 Sn, the elastic recovery increased from 35% to about 80%. It was probable that the addition of Mn suppressed slip deformation caused by dislocation and inhibited plastic deformation. The shape memory properties were not changed by room-temperature aging probably because Mn is an element that stabilizes βCuSn and thus inhibited the precipitation of s phase and L phase which would cause room-temperature aging. According to TEM, these CuSnMn alloys, unlike other Cu—Sn alloys, have no superfluous wing-shaped diffraction mottles arising from the s phase and the L phase. This shows that the precipitation of s phase or L phase by room-temperature aging does not occur. From the foregoing, it has been shown that Mn is an additive element that will inhibit room-temperature aging which is problematic in Cu—Sn shape memory alloys and that will be important for attaining stable shape memory effect.

Experimental Examples 4 to 8

Cu—Sn—Mn alloys were prepared and their shape memory properties were studied. Table 3 describes the compositions of the Cu—Sn—Mn alloys of Experimental Examples 4 to 8. Pure Cu, pure Sn, and pure Mn as raw materials were weighed so that the smelted alloy would have a composition close to the target composition, and were melted and cast in a mold in an air high-frequency melting furnace while blowing $N_2$ gas or Ar gas, thus forming a sample. The gas used in the melting and casting was $N_2$ gas in Experimental Examples 5 and 6, and Ar gas in Experimental Examples 4, 7 and 8. Because the sample as smelted and cast was inhomogeneous with residual solidification structure, a homogenization treatment was performed in an electric furnace at 700° C. for 24 hours. During this process, in order to prevent oxidation, the sample was vacuum-sealed in a quartz tube. The sample was worked into various shapes for testing, and supercooled high-temperature phase formation treatment was performed to render the sample into a β single phase. During this process too, in order to prevent oxidation, the sample was vacuum-sealed in a quartz tube, held for 30 minutes at respective temperatures in an electric furnace, and cooled in the following manners: furnace cooling, water cooling, oil cooling, air cooling, and quenching with −90° C. methanol. The cooling rates were estimated to be roughly 0.1° C./sec for furnace cooling, 1° C./sec for air cooling, 10° C./sec for oil cooling, 100° C./sec for water cooling, and 100° C./sec for quenching with −90° C. methanol. Some samples were thereafter subjected to aging treatment. The aging treatment was performed at room temperature for 10000 minutes after water cooling, or at 200° C. for 30 minutes after water cooling.

TABLE 3

| | Compotision Mass % | Compotision at % | β phased-temperature ° C. | Cooling Method |
|---|---|---|---|---|
| Experimental Example 4 | Cu—23.8Sn | Cu—14.3Sn | 700 | air cooling, oil cooling, water cooling, −90° $CCH_3OH$ |
| Experimental Example 5 | Cu—23.4Sn—1.9Mn | Cu—14.0Sn—2.5Mn | 700 | water cooling |
| Experimental Example 6 | Cu—22.0Sn—3.8Mn | Cu—13.0Sn—4.9Mn | 700 | furnance cooling, water cooling |
| Experimental Example 7 | Cu—21.9Sn—4.0Mn | Cu—13.6Sn—5.2Mn | 700 | air cooling, oil cooling, water cooling, −90° $CCH_3OH$ |
| Experimental Example 8 | Cu—20.5Sn—6.6Mn | Cu—12.0Sn—8.3Mn | 725 | air cooling, oil cooling, water cooling |

(Bending Test)

Figure 25:
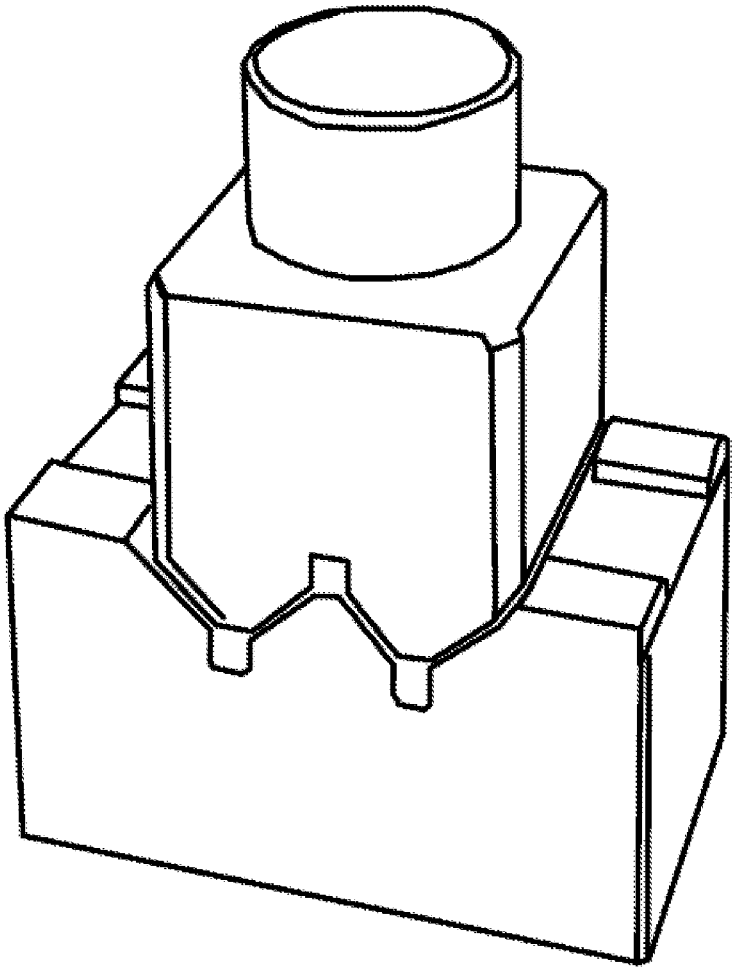
FIG. 25 is a drawing of W blocks for bending test.

The alloy ingot was cut to a thickness of about 0.3 mm with a fine cutter and a micro cutter, and the alloy piece was mechanically polished to a thickness of 0.15 mm by rotational polishing with waterproof abrasive paper No. 100 to 2000. Because the bending test samples were to be handled also as optical microscope observation samples, the samples were buff-polished with an alumina solution (0.3 μm) to attain a mirror surface. The samples were then subjected to supercooled high-temperature phase formation treatment. After the heat treatment, chemical etching was performed with diluted aqua regia (distilled water:hydrochloric acid: nitric acid=8:1:1). The heat-treated sample was bent by being pressed with use of W-shaped blocks as a guide which had R of 0.75 mm and a bending angle of 90°. FIG. 25 is a drawing of the W blocks for the bending test. The sample bending angle $\theta_0$ (=90°), the angle $\theta_1$ after unloading, and the angle $\theta_2$ after heat treatment at 700° C. for 1 minute were measured, and the elastic recovery and the elastic+thermal recovery were determined using Equation (1) described hereinabove and Equation (4). The measurement was performed with respect to the portion that had been bent by the central portion of the W blocks.

$$\text{Elastic+thermal recovery [\%]}=(1-\theta_2/\theta_0)\times 100 \quad \text{(mathematical formula 4)}$$

(Optical Microscope Observation)

The sample used for optical microscope observation was identical to the sample used for the bending test. For the optical microscope observation, digital microscope VH-8000 manufactured by Keyence Corporation was used. While this device had a range of magnification from 450× to 3000×, the observation was basically conducted at 450× magnification.

(X-Ray Powder Diffractometry)

The measurement sample preparation, measurement apparatus, measurement conditions, and analytical method were the same as in Experimental Example 1 described hereinabove.

(Transmission Electron Microscope (TEM) Observation)

The smelted alloy ingot was cut with a fine cutter and a micro cutter to a thickness of about 0.3 mm, and the alloy piece was mechanically polished to a thickness of 0.1 mm with a rotary polisher equipped with No. 100-800 waterproof abrasive paper. This thin-film sample was shaped into an approximate square 3 mm on each side, heat-treated, and electrolytically polished under the following conditions. Diluted sulfuric acid (950 mL distilled water, 50 mL sulfuric acid, 2 g sodium hydroxide, 15 g iron (II) sulfate) was used as the electrolytic polishing solution, and the sample was jet polished at a liquid temperature of about 5° C. to 10° C. The jet electrolytic polishers used were TenuPol III and V manufactured by STRUERS. The sample was observed on TEM immediately after the completion of electrolytic polishing. For TEM observation, Hitachi H-800 (side entry analysis mode) TEM (accelerating voltage: 175 kV) was used. During the observation, the crystal orientation was adjusted using a biaxial sample tilting mechanism so that the beam would be incident from 100 or 110 crystal zone. The exposure time was about 3 seconds in most cases. In most cases, the observation was made in bright-field imaging mode with an objective aperture placed in the transmitted waves.

(Differential Thermal Analysis (DTA))

The alloy ingot was cut with a fine cutter and a micro cutter into a cube which was about 3 mm in each of width, length and height, and the cube was mechanically polished to a mass of about 190 mg by rotational polishing with No. 240 waterproof abrasive paper. With use of TG/DTA 6200N and TG/DTA 6300 manufactured by Seiko Instruments Inc., the DTA measurement was performed in such a manner that the sample was heated from room temperature to 700° C. at 20° C./min and was thereafter cooled from 700° C. to room temperature at 20° C./min while recording a thermal analysis curve. During the measurement, nitrogen was flowed at a flow rate of 400 mL/min to prevent oxidation. Pure copper was used as a standard sample.

(Results and Discussions)

Table 4 describes the compositions, elastic recovery $R_E$ (%), elastic thermal recovery $R_{E+T}$ (%), and crystal phases detected by XRD in Experimental Examples 4 to 8. In each Experimental Example, the sub-numbers 1 to 7 indicate furnace cooling, air cooling, oil cooling, water cooling, −90° C. quenching, room-temperature aging after water cooling, and 200° C. aging after water cooling, respectively. Specifically, the air-cooled product in Experimental Example 7 is written as Experimental Example 7-2, and the water-cooled product in Experimental Example 7 as Experimental Example 7-4. As described in Table 4, Experimental Example 4-4 in which Mn was not added and the sample was water cooled resulted in a low, 18%, elastic recovery. The elastic recovery increased significantly to 61% in Experimental Example 4-6 in which the sample was aged at room temperature after water cooling. In Experimental Examples 5 and 6 which involved Mn, the samples had βCuSn phase as the main phase, showed an elastic recovery of not less than 40%, and attained high shape memory properties. In Experimental Examples 6 to 8, no significant change in recovery rate was seen before and after the room-temperature aging, showing high stability of the crystal. In Experimental Example 7, relatively high shape memory properties were attained even with as low a cooling rate as air cooling. Further, when the sample that had been heated to 400° C. or above was cooled at a low cooling rate, phases such as α phase and δ phase as well as intermetallic compounds (such as $Cu_4MnSn$) were precipitated to make it difficult to obtain a single phase, with the result that the alloy was brittle and was hard to work. Based on these results, it was assumed that the rate of cooling in treatments such as casting treatment and homogenization treatment would be preferably not less than the rate of oil cooling, for example, greater than −50° C./sec. Further, it was assumed that the Mn dose would be preferably in the range of 2.5 at % to 8.3 at %, and more preferably in the range of 7.5 at % and below in view of the fact that excessive addition of Mn results in precipitation of sub-phases.

TABLE 4

| | | Recovery Rate/% | | | | | |
|---|---|---|---|---|---|---|---|
| | | Furnance cooling Experimental Example X-1 | | Air cooling Experimental Example X-2 | | Oil cooling Experimental Example X-3 | |
| | Compotision | $R_E$ | $R_{E+T}$ | $R_E$ | $R_{E+T}$ | $R_E$ | $R_{E+T}$ |
| Experimental Example 4 | Cu—14.3Sn | | | Cracking α β δ | | Cracking α β δ (M) | |
| Experimental Example 5 | Cu—14.0Sn—2.5Mn | | | | | | |

TABLE 4-continued

| | | | | | | | | | |
|---|---|---|---|---|---|---|---|---|---|
| Experimental Example 6 | Cu—13.0Sn—4.9Mn | Cracking<br>α β δ | | | | | | | |
| Experimental Example 7 | Cu—13.6Sn—5.2Mn | | | 47<br>(α)β(δ) | 93<br>(Cu$_4$MnSn) | 66<br>β | 71 | | |
| Experimental Example 8 | Cu—12.0Sn—8.3Mn | | | β α δ Cu$_4$MnSn | | 42<br>β α Cu$_4$MnSn | 47 | | |

| | Recovery Rate/% | | | | | | | |
|---|---|---|---|---|---|---|---|---|
| | Water cooling Experimental Example X-4 | | −90° C. Experimental Example X-5 | | Water cooling room-temperature aging Experimental Example X-6 | | Water cooling 200° C. aging Experimental Example X-7 | |
| | $R_E$ | $R_{E+T}$ | $R_E$ | $R_{E+T}$ | $R_E$ | $R_{E+T}$ | $R_E$ | $R_{E+T}$ |
| Experimental Example 4 | 18<br>β (M) | 88 | 38<br>α β M | 45 | 61<br>β | 94 | | |
| Experimental Example 5 | 67<br>β | | | | 74 | | | |
| Experimental Example 6 | 63<br>β | 85 | | | 75<br>β | 80 | Cracking | |
| Experimental Example 7 | 60<br>β | 72 | 73<br>β | 95 | 68<br>β | 72 | | |
| Experimental Example 8 | 62<br>β(α)(Cu$_4$MnSn) | 77 | | | 53<br>β | 59 | | |

Figure 26A:
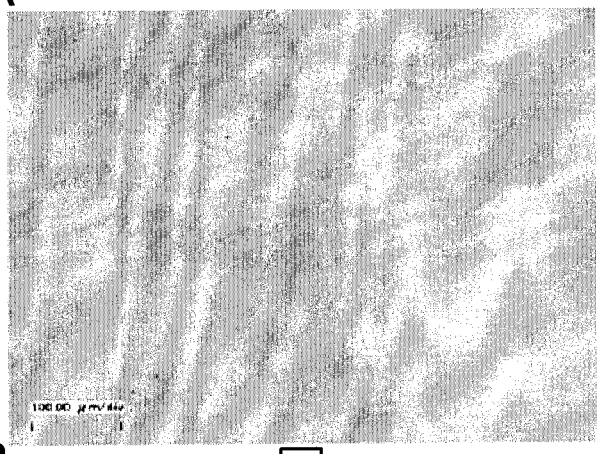
FIGS. 26A to 26C show optical microscope observation results of an alloy foil of Experimental Example 7-2 (air cooling).
Figure 26B:
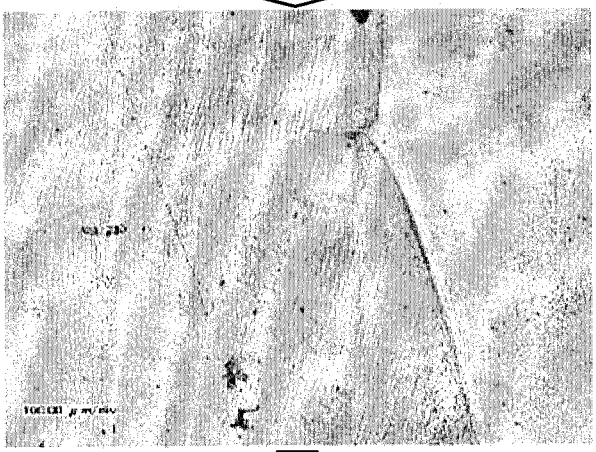
Figure 26C:
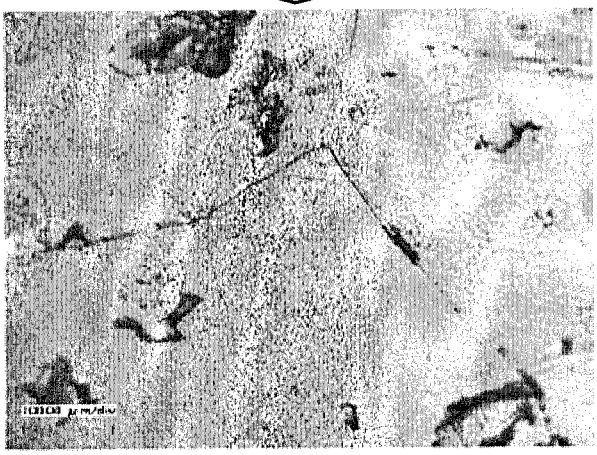
Figure 27A:
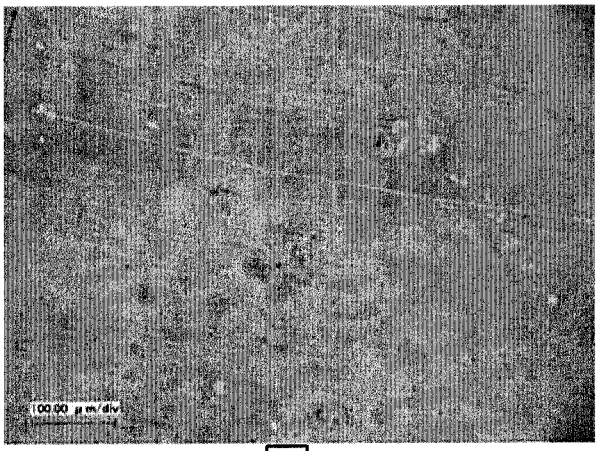
FIGS. 27A to 27C show optical microscope observation results of an alloy foil of Experimental Example 7-3 (oil cooling).
Figure 27B:
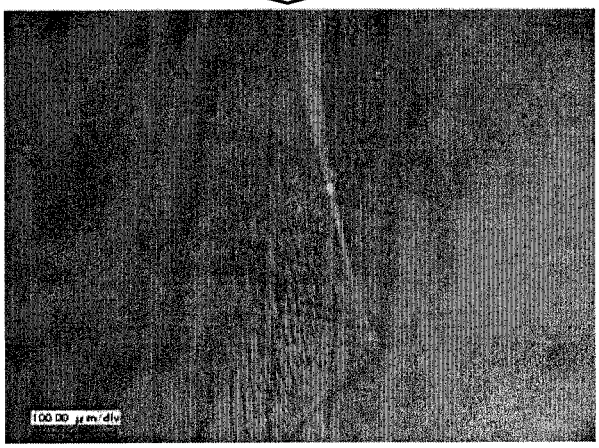
Figure 27C:
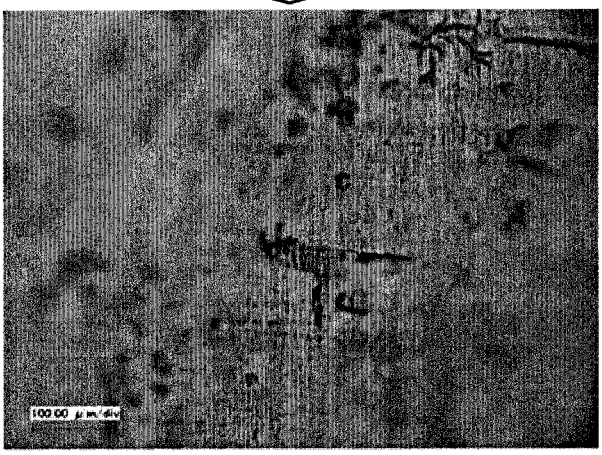
Figure 28A:
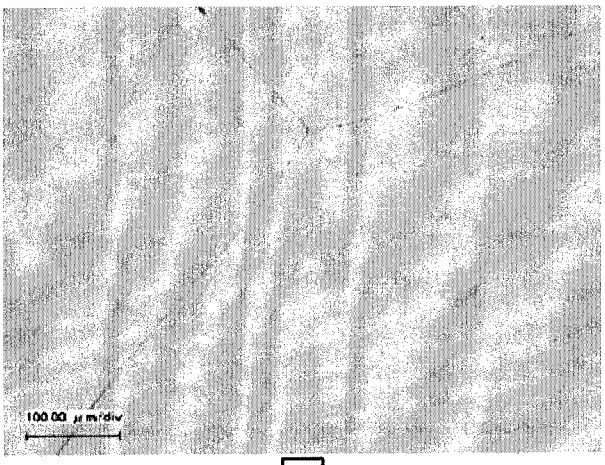
FIGS. 28A to 28C show optical microscope observation results of an alloy foil of Experimental Example 7-4 (water cooling).
Figure 28B:
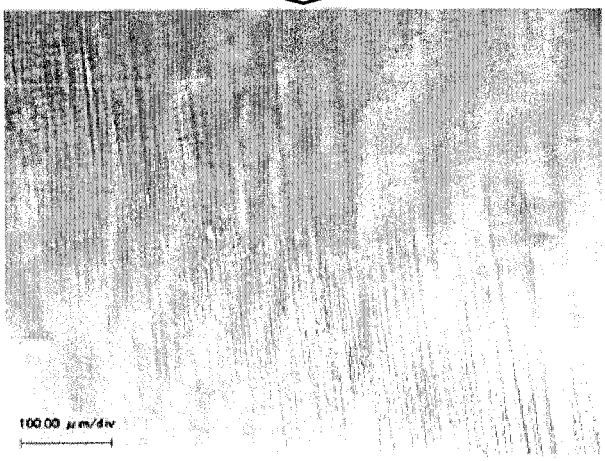
Figure 28C:
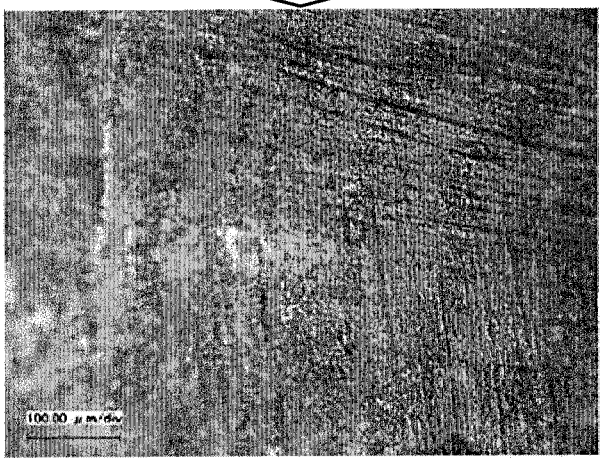
Figure 29A:
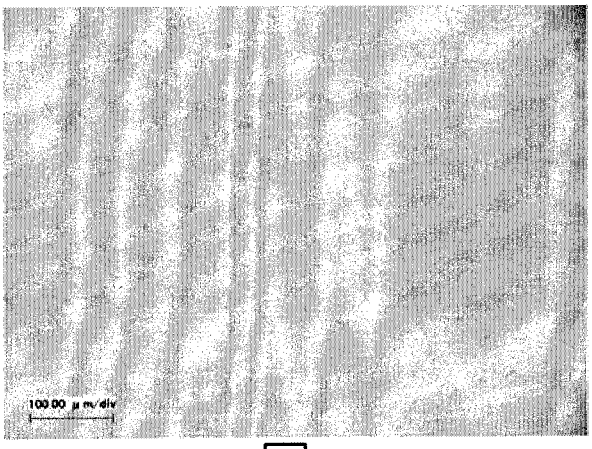
FIGS. 29A to 29C show optical microscope observation results of an alloy foil of Experimental Example 7-5 (−90° C. cooling).
Figure 29B:
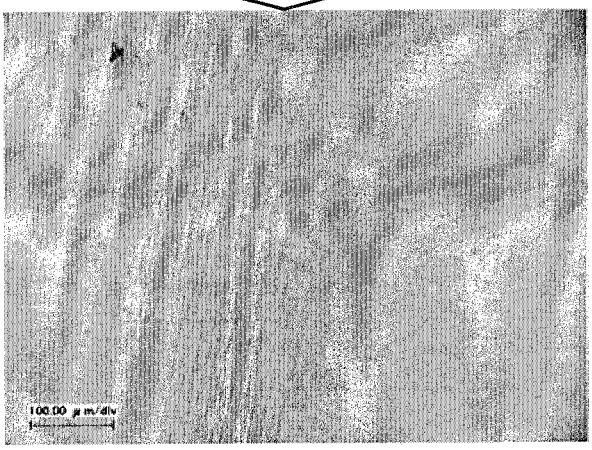
Figure 29C:
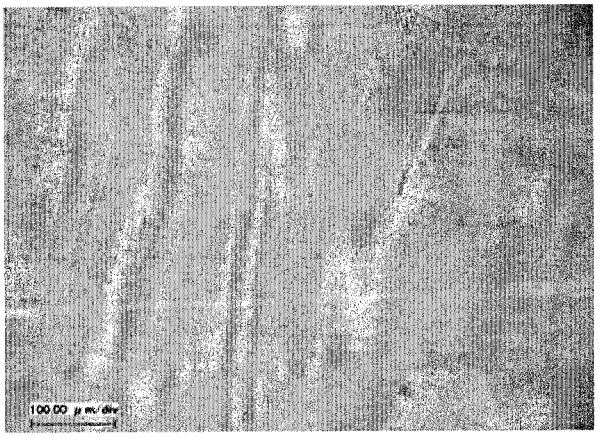
Figure 31:
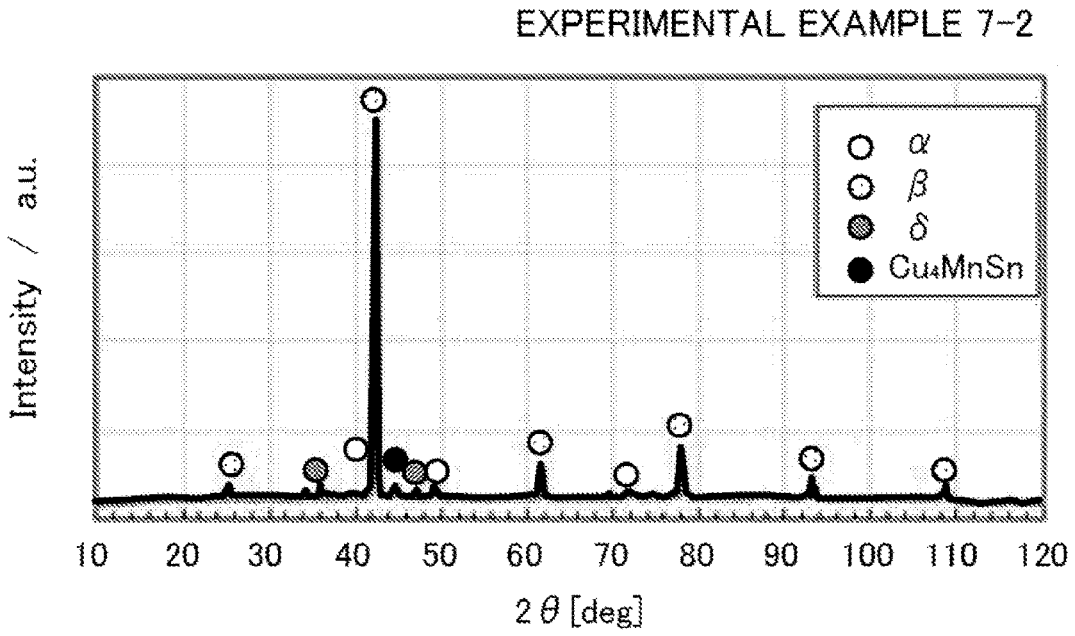
FIG. 31 shows XRD measurement results of Experimental Example 7-2 (air cooling).
Figure 32:
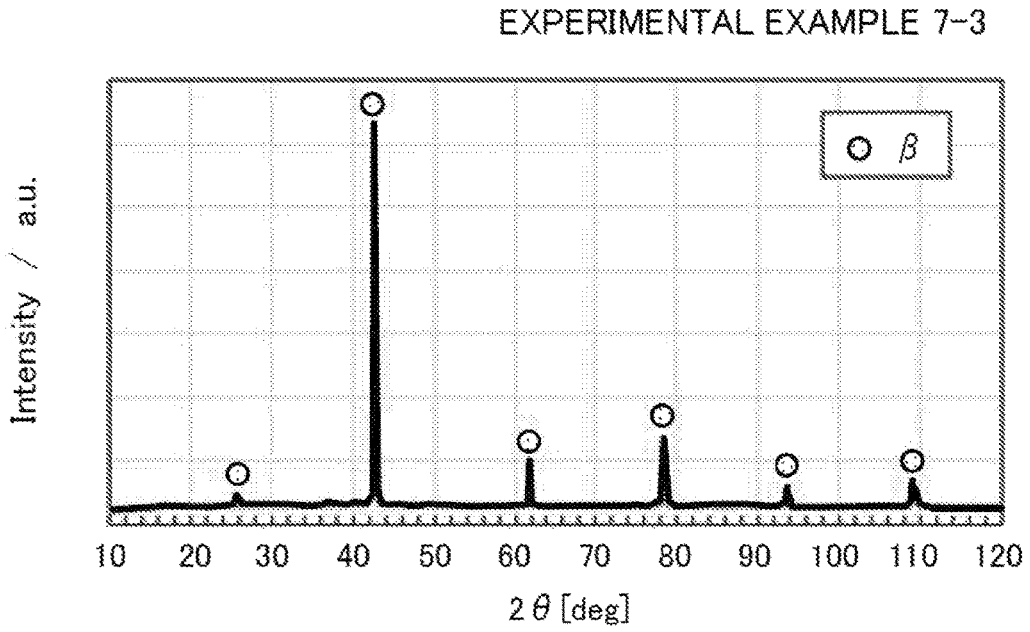
FIG. 32 shows XRD measurement results of Experimental Example 7-3 (oil cooling).
Figure 33:
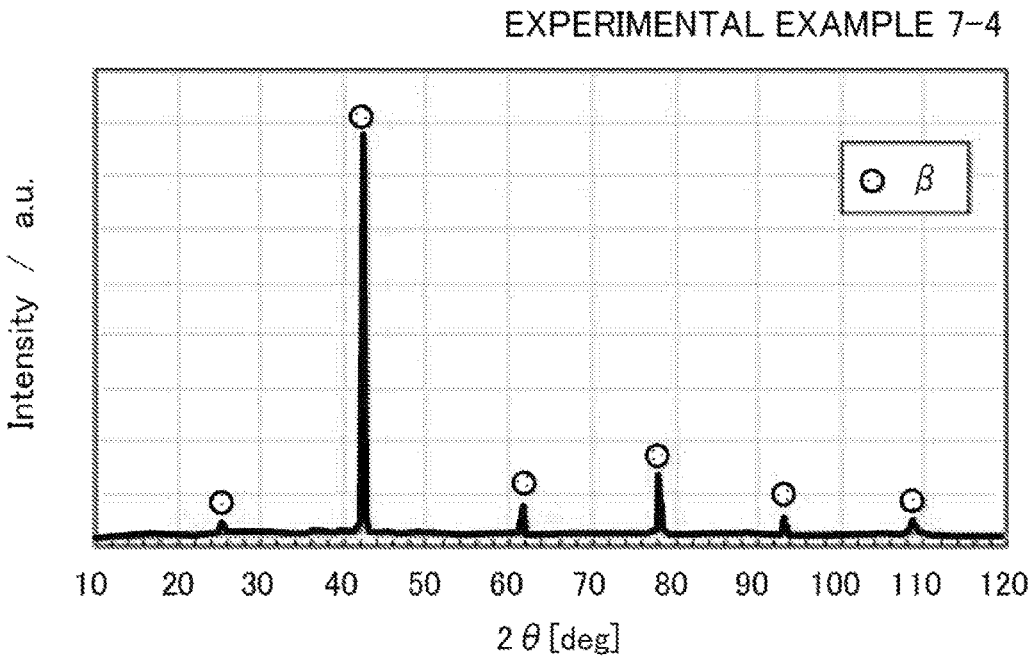
FIG. 33 shows XRD measurement results of Experimental Example 7-4 (water cooling).
Figure 34:
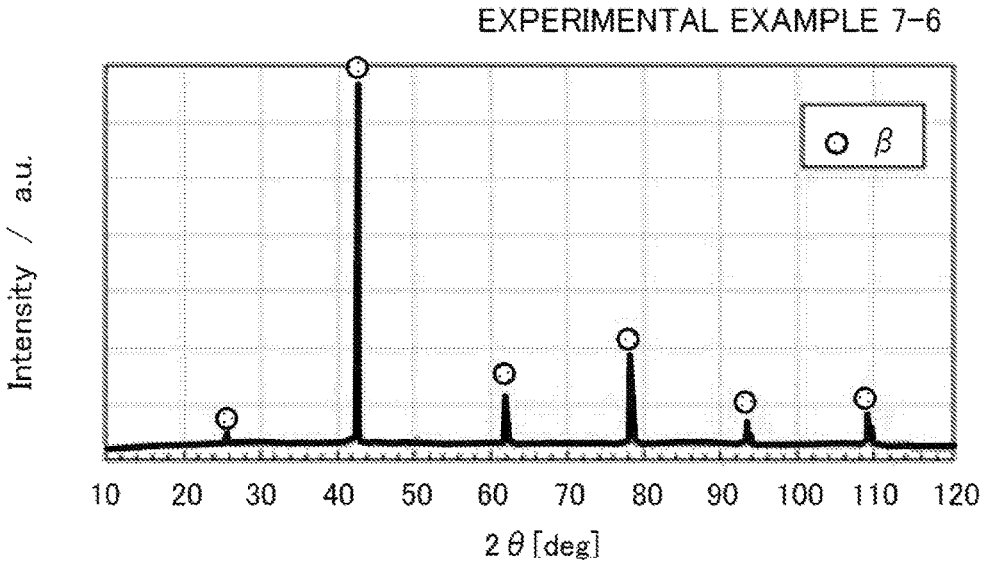
FIG. 34 shows XRD measurement results of Experimental Example 7-6 (room-temperature aging after water cooling).

1) Elastic Recovery$R_E$(%), Elastic Thermal Recovery$R_{E+T}$(%)
2) The lower part shows the crystal phase detected by XRD.
M is the martensite, ( ) is the phase which is considered to be contained
3) Blank fields are not measured The measurement results of Experimental Example 7 will be illustrated as a specific example of the copper alloys prepared above. FIGS. 26 to 29 show the optical microscope observation results of the alloy foils of Experimental Examples 7-2 to 5 (air cooling, oil cooling, water cooling and −90° C. cooling). In each of the figures, (a) is a photograph after the supercooled high-temperature phase formation treatment, (b) is a photograph taken during bending deformation, and (c) is a photograph after thermal recovery. FIGS. 30A to 30E show the TEM observation results of Experimental Example 7. FIGS. 31 to 34 show the XRD measurement results of the copper alloys of Experimental Examples 7-2 to 4, and 6 (air cooling, oil cooling, water cooling, and room-temperature aging after water cooling). As illustrated in FIGS. 26A to 26C, martensite was not seen after the supercooled high-temperature phase formation treatment in Experimental Example 7-2 (FIG. 26A), but stress-induced martensite occurred during deformation (FIG. 26B). After the heat treatment, the stress-induced martensite was almost extinct (FIG. 26C). Similar results were obtained in FIGS. 27 to 29. Results similar to those in Experimental Example 2 were obtained in Experimental Examples 4 to 8. In Experimental Example 7-2 (air cooling) in which the cooling rate was low, minute amounts of phases such as α phase and δ phase were detected in addition to β phase. The other samples of Experimental Example 7 were of a βCuSn single phase.

Figure 35:
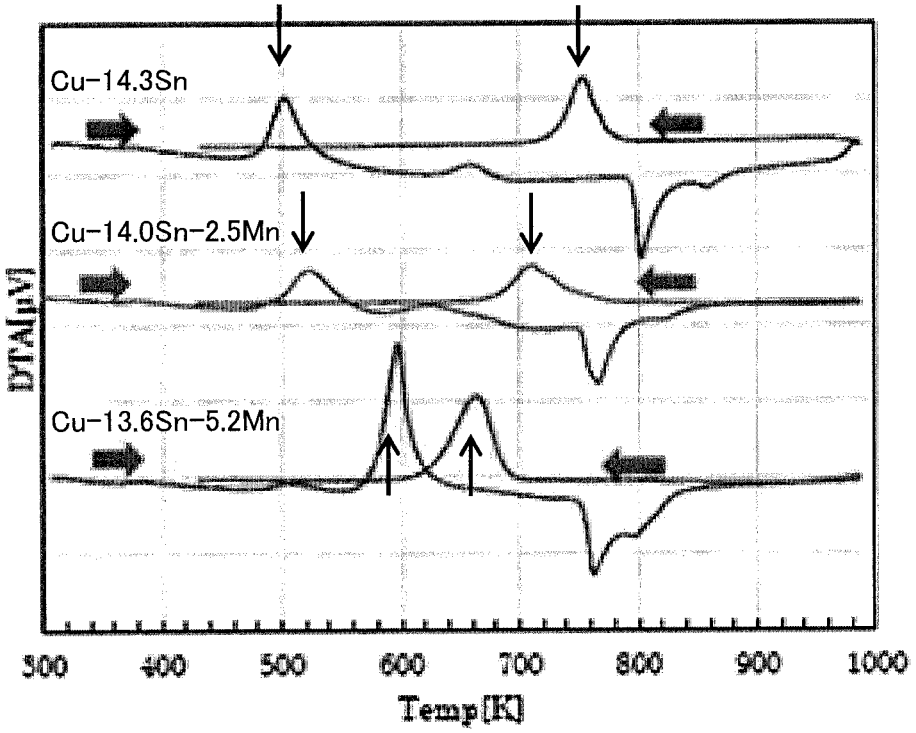
FIG. 35 shows DTA measurement results of Experimental Examples 4, 5 and 7.

FIG. 35 shows the DTA measurement results of Experimental Examples 4, 5 and 7. As shown in FIG. 35, the change in Mn dose with constant ratio of Cu and Sn resulted in a positive shift in temperature which caused phase separation of β phase during heating with increasing Mn concentration, and resulted in a negative shift in temperature which caused eutectoid transformation of β phase during cooling with increasing Mn concentration. It has been shown that the increase in the amount of solute Mn broadens the range of temperatures at which the βCuSn phase exists stably, that is, stabilizes the βCuSn phase. Based on these results, it has been demonstrated that Mn can enhance the thermal stability of βCuSn phase and the addition of Mn will make it possible to prevent changes in characteristics due to room-temperature aging.

The present application claims priority from U.S. provisional Patent Application No. 62/313,228 filed on Mar. 25, 2016, the entire contents of which are incorporated herein by reference.

What is claimed is:

1. A copper alloy having an alloy composition represented by $Cu_{100-(x+y)}Sn_xMn_y$, where $10 \leq x \leq 16$ and $2 \leq y \leq 10$ are satisfied, wherein a main phase is a βCuSn phase with Mn dissolved therein, and the βCuSn phase undergoes martensitic transformation when heat-treated or worked.

2. The copper alloy according to claim 1, having at least one selected from a shape memory effect and a super elastic effect at a temperature equal to or lower than a melting point.

3. The copper alloy according to claim 1, wherein an elastic recovery (%) determined from an angle θ observed when a flat plate of the copper alloy is unloaded after being bent at a bending angle of $\theta_0$ is 40% or more.

4. The copper alloy according to claim 1, wherein, a thermal recovery (%) determined from an angle θ observed when a flat plate of the copper alloy is heated to a recovery temperature, which is determined on a basis of the βCuSn phase, after being bent at a bending angle of $\theta_0$ is 40% or more.

5. The copper alloy according to claim 1, wherein an elastic thermal recovery (%) determined from an angle $\theta_1$, which is observed when a flat plate of the copper alloy is unloaded after being bent at a bending angle of $\theta_0$, and an angle $\theta_2$, which is observed when the flat plate is further heated to a recovery temperature determined on a basis of the βCuSn phase, is 45% or more.

6. The copper alloy according to claim 1, wherein, in surface observation, an area ratio of the βCuSn phase contained is in a range of 50% or more and 100% or less.

7. The copper alloy according to claim 1, comprising a polycrystal or a single crystal.

8. The copper alloy according to claim 1, wherein the copper alloy is homogenized.

9. A method for producing a copper alloy that undergoes martensitic transformation when heat-treated or worked, wherein, among a casting step of melting and casting a raw material containing Cu, Sn, and Mn and having an alloy composition represented by $Cu_{100-(x+y)}Sn_xMn_y$, where $10 \leq x \leq 16$ and $2 \leq y \leq 10$ are satisfied, so as to obtain a cast material with a main phase that is a βCuSn phase with Mn dissolved therein, and a homogenization step of homogenizing the cast material in a temperature range of a βCuSn phase so as to obtain a homogenized material, the method comprises at least the casting step.

10. The method for producing a copper alloy according to claim 9, wherein, in the casting step, the raw material is melted in a temperature range of 750° C. or higher and 1300° C. or lower, and cooled from 800° C. to 400° C. at a cooling rate of −50° C./s to −500° C./s.

11. The method for producing a copper alloy according to claim 9, wherein, in the homogenization step, the cast material is held in a temperature range of 600° C. or higher and 850° C. or lower and then cooled at a cooling rate of −50° C./s to −500° C./s.

12. The method for producing a copper alloy according to claim 9, further comprising:

at least one working step of cold-working or hot-working at least one selected from the cast material and the homogenized material into at least one shape selected from a plate shape, a foil shape, a bar shape, a line shape, and a particular shape.

13. The method for producing a copper alloy according to claim 12, wherein, in the working step, hot-working is conducted in a temperature range of 500° C. or higher and 700° C. or lower and then cooling is conducted at a cooling rate of −50° C./s to −500° C./s.

14. The method for producing a copper alloy according to claim 12, wherein, in the working step, working is conducted by a method that suppresses occurrence of shear deformation so that a reduction in area is 50% or less.

15. The method for producing a copper alloy according to claim 9, further comprising:

an aging or ordering step of subjecting at least one selected from the cast material and the homogenized material to an age hardening treatment or an ordering treatment so as to obtain an age-hardened material or an ordered material.

16. The method for producing a copper alloy according to claim 15, wherein in the aging step, the age-hardening treatment or the ordering treatment is performed in the temperature range of 100° C. or higher and 400° C. or lower for a time period of 0.5 hours or more and 24 hours or less.

* * * * *